US009656821B2

(12) United States Patent
Kato et al.

(10) Patent No.: US 9,656,821 B2
(45) Date of Patent: May 23, 2017

(54) MULTI-FEED DETECTION APPARATUS, SHEET CONVEYANCE APPARATUS, AND IMAGE FORMING APPARATUS

(71) Applicant: Konica Minolta, Inc., Chiyoda-ku, Tokyo (JP)

(72) Inventors: Takaki Kato, Toyokawa (JP); Toshinori Inomoto, Toyokawa (JP); Masayuki Fukunaga, Toyohashi (JP); Isao Watanabe, Toyohashi (JP); Toshiaki Tanaka, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/982,704

(22) Filed: Dec. 29, 2015

(65) Prior Publication Data

US 2016/0194168 A1 Jul. 7, 2016

(30) Foreign Application Priority Data

Jan. 6, 2015 (JP) ..... 2015-000954

(51) Int. Cl.
*B65H 7/12* (2006.01)
*G03G 15/00* (2006.01)

(52) U.S. Cl.
CPC ..... *B65H 7/125* (2013.01); *G03G 15/703* (2013.01); *B65H 2511/413* (2013.01);
(Continued)

(58) Field of Classification Search
CPC ..... B65H 2553/30; B65H 2511/524; B65H 7/125; B65H 7/12
(Continued)

(56) References Cited

U.S. PATENT DOCUMENTS 5,121,915 A * 6/1992 Duncan ..... B65H 7/02 271/111
6,234,470 B1 * 5/2001 Okitsu ..... B65H 3/5261 271/10.11

(Continued)

FOREIGN PATENT DOCUMENTS

JP 11165891 A 6/1999
JP 2004284778 A 10/2004

(Continued)

OTHER PUBLICATIONS

Japanese Notification of Reasons for Refusal corresponding to Japanese patent application No. 2015-000954; Dated: Feb. 28, 2017, with partial English translation.

(Continued)

*Primary Examiner* — Patrick Cicchino
(74) *Attorney, Agent, or Firm* — Cantor Colburn LLP

(57) ABSTRACT

A multi-feed detection apparatus for detecting multi-feed of a sheet conveyed along a paper path is provided. The apparatus includes a first movement amount sensor disposed on the paper path to face a first surface of the sheet to detect a movement amount of the sheet; a second movement amount sensor disposed, on the paper path, in a position at which the first movement amount sensor is disposed to face a second surface of the sheet to detect a movement amount of the sheet; and a determination portion configured to determine that a conveyance state of the sheet is multi-feed when a difference between the movement amount of the sheet detected by the first movement amount sensor and the movement amount of the sheet detected by the second movement amount sensor is equal to or greater than a threshold.

21 Claims, 24 Drawing Sheets

(52) U.S. Cl.
CPC .... *B65H 2511/524* (2013.01); *B65H 2513/10* (2013.01); *B65H 2515/112* (2013.01); *B65H 2515/805* (2013.01); *B65H 2553/414* (2013.01); *B65H 2553/42* (2013.01); *B65H 2557/51* (2013.01)

(58) Field of Classification Search
USPC ..... 271/111
See application file for complete search history.

(56) References Cited

U.S. PATENT DOCUMENTS

| | | | | |
|---|---|---|---|---|
| 6,439,563 | B1 * | 8/2002 | Kayani | B65H 3/047 271/10.03 |
| 6,554,275 | B1 * | 4/2003 | Tranquilla | B65H 3/063 271/110 |
| 7,658,374 | B2 * | 2/2010 | Yasukawa | B65H 3/06 271/111 |
| 2004/0188916 | A1 * | 9/2004 | Tsukamoto | B65H 3/06 271/110 |
| 2005/0228535 | A1 * | 10/2005 | Simonis | B65H 7/125 700/228 |
| 2010/0096799 | A1 * | 4/2010 | Shiraiwa | B65H 3/06 271/111 |
| 2012/0307282 | A1 * | 12/2012 | Ishikawa | B65H 7/125 358/1.14 |
| 2014/0091516 | A1 * | 4/2014 | Okitsu | B65H 7/125 271/262 |
| 2015/0239695 | A1 * | 8/2015 | Noda | B65H 7/14 271/265.01 |

FOREIGN PATENT DOCUMENTS

| | | | |
|---|---|---|---|
| JP | 2004359462 | A | 12/2004 |
| JP | 2007008654 | A | 1/2007 |
| JP | 2007153560 | A | 6/2007 |
| JP | 2008013365 | A | 1/2008 |
| JP | 2008184260 | A | 8/2008 |
| JP | 2009001408 | A | 1/2009 |
| JP | 2011157141 | A | 8/2011 |
| JP | 2014159323 | A | 9/2014 |

OTHER PUBLICATIONS

Chinese Official Communication corresponding to Patent Application No. 201610006252.4; Dated Feb. 22, 2017, with partial English translation.

* cited by examiner

FIG. 10

TA1

| PAPER TYPE | PAPER BASIS WEIGHT [g/m²] | DURABILITY COEFFICIENT α | HUMIDITY COEFFICIENT β |
|---|---|---|---|
| THICK PAPER (INCLUDING COATED PAPER) | 201～300 | α1 | β |
| | 151～200 | | |
| | 91～150 | | |
| PLAIN PAPER | 65～90 | α2 | |
| | ～64 | | |

FIG. 12

TA3

| HUMIDITY | 0~30% | 31~60% | 61%~ |
|---|---|---|---|
| HUMIDITY COEFFICIENT $\beta$ | 1. 00 | 1. 05 | 1. 10 |

MULTI-FEED DETECTION APPARATUS, SHEET CONVEYANCE APPARATUS, AND IMAGE FORMING APPARATUS

CROSS REFERENCE TO RELATED APPLICATIONS

The present invention claims priority under 35 U.S.C. §119 to Japanese Application No. 2015-000954 filed on Jan. 6, 2015, the entire content of which is incorporated herein by reference.

BACKGROUND OF THE INVENTION

Field of the Invention

The present invention relates to a multi-feed detection apparatus for detecting multi-feed of sheets conveyed along a paper path, a sheet conveyance apparatus, and an image forming apparatus.

Description of the Related Art

Image forming apparatuses, e.g., printers, copiers, and multi-function devices, have a paper containing portion such as a paper cassette or a paper tray. Sheets of paper are stacked and held in the paper containing portion. When such an image forming apparatus is given a print job, sheets of paper are supplied, one by one, from the paper containing portion, and the image forming apparatus performs printing onto the sheets which are being conveyed, and outputs the sheets onto which printing has been carried out.

In general, upon determining that a trouble related to paper conveyance has occurred, the image forming apparatus stops the paper conveyance instantly, suspends the execution of the print job, and displays an error message to prompt a user to take some measures against the trouble. After that, the image forming apparatus waits for the user to remove the paper which remains in the paper path.

The trouble related to paper conveyance includes a trouble in which a plurality of sheets of paper partly overlapping each other along the conveyance direction is conveyed. Such a trouble is called "multi-feed". The multi-feed occurs when pickup rollers and so on take the top sheet from the paper containing portion. The multi-feed occurs because a sheet of paper right down the topmost paper which is being taken out of the paper containing portion is dragged due to friction or electrostatic adsorption on the topmost paper.

In relation to multi-feed detection, a technology using an ultrasonic sensor has been proposed. According to the technology, a transmission part and a receiving part of the ultrasonic sensor are disposed in a paper path to face each other with paper passing therebetween. Whether multi-feed occurs or not is determined based on an ultrasonic wave received signal penetrating through the paper which is being conveyed (Japanese Unexamined Patent Application Publication No. 2011-157141).

Another technology for detecting multi-feed with a photo-interrupter has been proposed. According to the technology, whether multi-feed occurs or not is determined based on the amount of light received of detection light passing through the paper.

Another detection method has been proposed in which a displacement meter for detecting displacement of a lever with an encoder is used to detect, as multi-feed, a change in thickness of paper which is being conveyed.

As another conventional technology related to conveyance, a technology by a postal item processing device has been proposed. The device conveys a paper sheet with a pair of conveying belts and detects travel speeds of the conveying belts. When a difference between the travel speeds thereof is equal to or greater than a predetermined value, the device provides a notification (Japanese Unexamined Patent Application Publication No. 2014-159323). In order to detect the travel speeds, transparent holes are formed at a constant pitch along the conveyance direction. The detection light passing through the transparent holes are received to determine the travel speeds based on the period of light received and the pitch of the transparent holes.

For detection of multi-feed, the use of a contact sensor such as a displacement meter causes a problem that the paper face is scratched due to the contact by a lever. Such a scratch is conspicuous in, particularly, coated paper, e.g., gloss paper for photoprint, so that the quality of a printed matter is reduced.

The use of an ultrasonic sensor enables multi-feed detection in a non-contact manner with respect to a specific type (paper type) of paper of which an attenuation factor of ultrasonic wave transmitting the paper is known. However, the attenuation factor of ultrasonic wave differs depending on the paper type. This makes it difficult to detect multi-feed independently of the paper type. In particular, when paper used for printing is two-ply paper having a structure of two or more sheets overlapping each other, e.g., an envelope or a slip form, the ultrasonic sensor is not capable of distinguishing between multi-feed of sheets of normal paper and normal feed of such two-ply paper.

Further, in using the ultrasonic sensor, in order to prevent an erroneous detection due to influence of sneaking of ultrasonic wave, it is necessary to determine that multi-feed occurs when a state of received sound amount equal to or lower than a threshold continues for a predetermined time. Thus, unfortunately, it is impossible to detect multi-feed of sheets slightly overlapping each other.

In using a photo-interrupter for detection of multi-feed of sheets, there is a problem that paper usable for printing is limited only to translucent paper. When paper having a small light transmittance, e.g., thick paper or colored paper, is used for printing, the photo-interrupter is incapable of detecting multi-feed of sheets.

SUMMARY

The present disclosure has been achieved in light of such an issue, and therefore, an object of an embodiment of the present invention is to detect multi-feed in a non-contact manner without deteriorating the sheet independently of what type of sheet is used.

According to an aspect of the present invention, a multi-feed detection apparatus for detecting multi-feed of a sheet conveyed along a paper path includes a first movement amount sensor disposed on the paper path to face a first surface of the sheet to detect a movement amount of the sheet; a second movement amount sensor disposed, on the paper path, in a position at which the first movement amount sensor is disposed to face a second surface of the sheet to detect a movement amount of the sheet; and a determination portion configured to determine that a conveyance state of the sheet is multi-feed when a difference between the movement amount of the sheet detected by the first movement amount sensor and the movement amount of the sheet detected by the second movement amount sensor is equal to or greater than a threshold.

These and other characteristics and objects of the present invention will become more apparent by the following descriptions of preferred embodiments with reference to drawings.

BRIEF DESCRIPTION OF THE DRAWINGS

FIG. 10 is a diagram showing an example of a table in which a durability coefficient and a humidity coefficient related to a threshold used for multi-feed detection are set in accordance with the sheet type.

FIG. 12 is a diagram showing an example of a table in which a humidity coefficient is set in accordance with a humidity.

DESCRIPTION OF THE PREFERRED EMBODIMENTS

Figure 1:
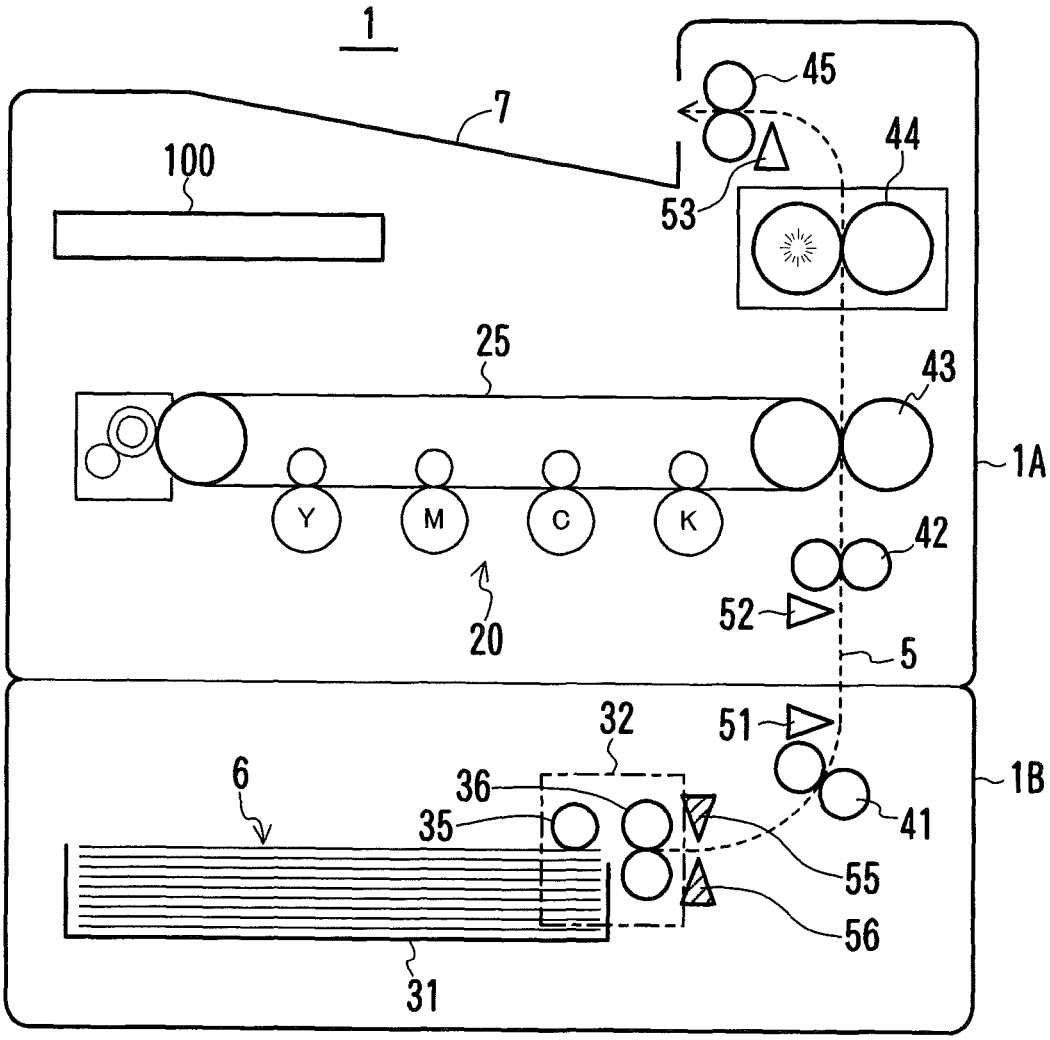
FIG. 1 is a schematic diagram showing an example of the structure of an image forming apparatus according to an embodiment of the present invention.
Figure 2:
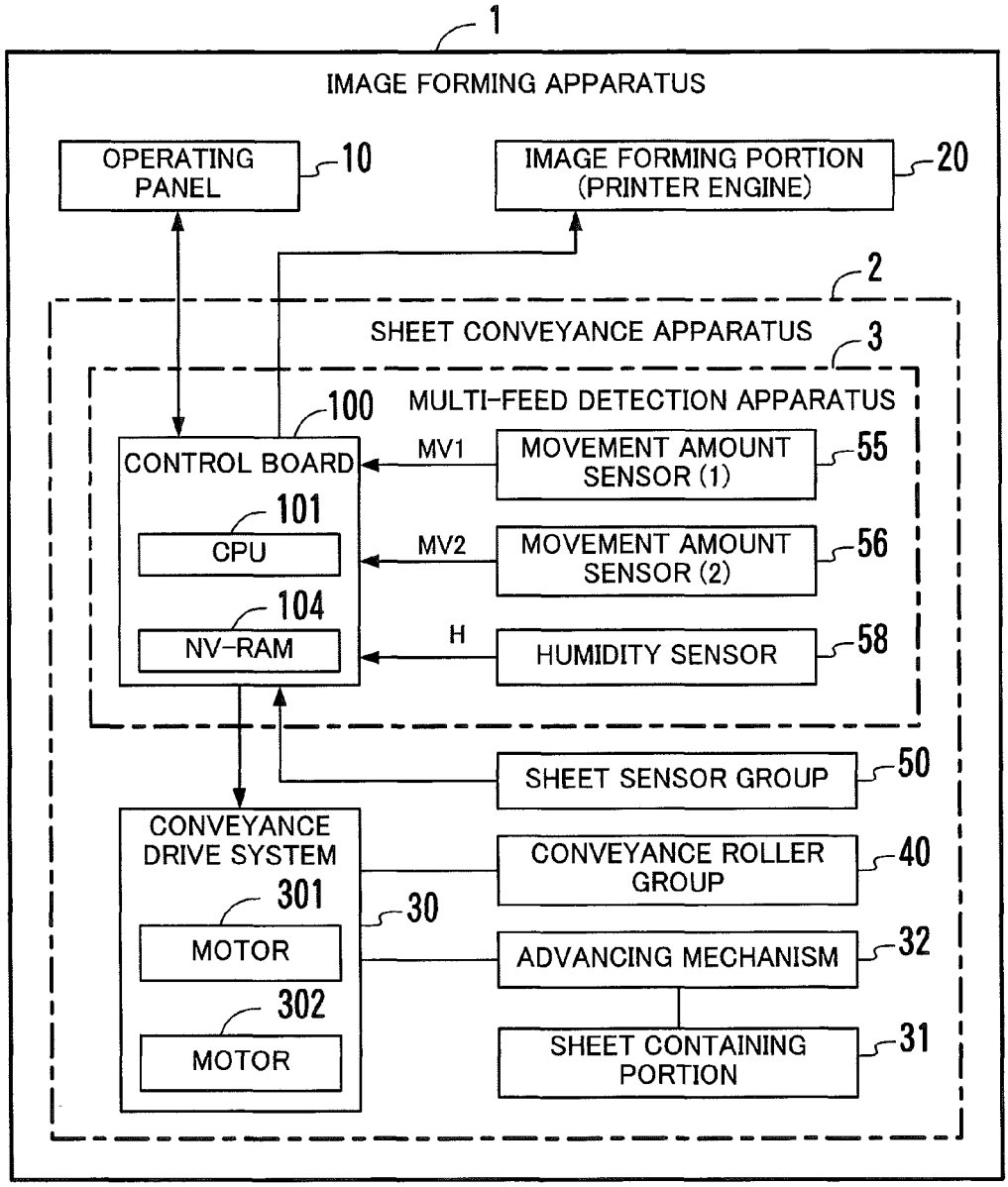
FIG. 2 is a block diagram showing an example of the hardware configuration of a sheet conveyance apparatus and a multi-feed detection apparatus provided in an image forming apparatus.

FIG. 1 is a schematic diagram showing an example of the structure of an image forming apparatus 1 according to an embodiment of the present invention. FIG. 2 shows an example of the hardware configuration of a sheet conveyance apparatus 2 and a multi-feed detection apparatus 3 provided in the image forming apparatus 1.

The image forming apparatus 1 is an electrophotographic color printer which includes a cassette-type sheet containing portion 31 in which a plurality of sheets 6 can be held, and a tandem image forming portion (printer engine) 20. The image forming apparatus 1 is not limited to such a printer. The image forming apparatus 1 may be a copier, a multi-function device, or a facsimile machine. The image forming apparatus 1 may be such a device provided with an engine for monochrome printing.

The image forming apparatus 1 supplies a sheet 6 contained in the sheet containing portion 31 to a paper path 5, and forms an image onto the sheet 6 while conveying the sheet 6 along the paper path 5. The image forming apparatus 1 then discharges the sheet 6 on which the image has been formed to a tray 7 with discharge rollers 45. The image forming apparatus 1 may be configured by combining a main unit 1A including the image forming portion 20 and a one-stage sheet container unit 1B including the sheet containing portion 31.

Referring to FIG. 1, an advancing mechanism 32 for supplying the sheet 6 to the paper path 5 is a reverse separation type advancing mechanism which includes a pickup roller 35 for taking the topmost sheet 6 out of the sheet containing portion 31 and advancing rollers 36 for sending out the sheet 6 thus taken out. The advancing mechanism is not limited thereto, and may be another type of advancing mechanism 32.

The paper path 5 starts from the advancing mechanism 32, goes to conveyance rollers 41, timing rollers 42, a secondary transfer roller 43, fixing rollers 44 in the stated order, and leads to the discharge rollers 45.

Since the conveyance distance from the advancing mechanism 32 to the timing rollers 42 is longer than the sheet 6, the conveyance rollers 41 are provided to relay the sheet 6 supplied to the paper path 5 to the timing rollers 42. In this embodiment, the conveyance rollers 41 are a pair of two driving rollers to which the rotational driving force is transmitted from a motor 302 (see FIG. 2) to rotate at the same circumferential velocity.

The timing rollers 42 deliver, at a predetermined time, the sheet 6 to a transfer position which is a nip of the secondary transfer roller 43. The secondary transfer roller 43 transfers, onto the sheet 6, a toner image that has been transferred to the transfer belt 25 by the image forming portion 20. The fixing rollers 44 apply heat and pressure to the sheet 6 onto which the toner image has been transferred.

A conveyance sensor 51 is disposed in the vicinity of the downstream of the conveyance rollers 41 on the paper path 5. A timing sensor 52 is disposed in the vicinity of the upstream of the timing rollers 42 on the paper path 5. A discharge sensor 53 is disposed in the vicinity of the discharge rollers 45. Each of the conveyance sensor 51, the timing sensor 52, and the discharge sensor 53 is a sheet sensor to detect the presence/absence of the sheet 6 at the individual installation locations, and is used to detect the position of the sheet 6 which is being conveyed.

On the paper path 5, a first movement amount sensor 55 and a second movement amount sensor 56 are disposed. The first movement amount sensor 55 is provided to face one surface of the sheet 6 to detect a movement amount of the sheet 6. The second movement amount sensor 56 is provided at the position of the first movement amount sensor 55 to face the other surface of the sheet 6 to detect a movement amount of the sheet 6. In short, the movement amount sensors 55 and 56 face each other with the paper path 5 interposed therebetween. The movement amount sensors 55 and 56 are so provided to detect a movement amount of the sheet 6, which passes through therebetween, from the front and rear of the sheet 6 concurrently. The movement amount detected by the movement amount sensors 55 and 56 corresponds to the speed of the sheet 6 moving along the paper path 5.

The movement amount sensors 55 and 56 are disposed in the foregoing manner and the results of detection thereby are compared with each other. This enables detection of multi-feed of the sheets 6 as described later.

The movement amount sensors 55 and 56 are preferably disposed in the upstream of the transfer position on the paper path 5. More preferably, the movement amount sensors 55 and 56 are disposed in the vicinity of the advancing mechanism 32 (around the start point of the paper path 5). Disposing the movement amount sensors 55 and 56 in the upstream of the transfer position makes it possible to detect multi-feed before the sheet 6 reaches the transfer position, and to stop the conveyance. This prevents the toner image from being transferred onto a plurality of sheets 6. The movement amount sensors 55 and 56 are disposed in the vicinity of the advancing mechanism 32. This enables early detection of multi-feed, which makes it possible to stop the conveyance at a stage where the user easily removes the sheet 6.

Referring to FIG. 2, the image forming apparatus 1 is configured of an operating panel 10 through which the user enters a command, the image forming portion 20, the sheet conveyance apparatus 2 for conveying the sheet 6 along the paper path 5. The operating panel 10 has a start key to give a command to start job execution.

The sheet conveyance apparatus 2 includes the multi-feed detection apparatus 3 for detecting multi-feed of sheets 6 conveyed along the paper path 5, a conveyance drive system 30, the sheet containing portion 31, the advancing mechanism 32, a conveyance roller group 40, and a sheet sensor group 50.

The conveyance drive system 30 includes a power source for driving the advancing mechanism 32, a power source for driving the conveyance roller group 40, a mechanism for transmitting the rotational driving force to the rollers, and other elements necessary for advancement and conveyance. The conveyance drive system 30 includes a motor 301 which is a power source of the advancing mechanism 32, and a motor 302 which is a power source of the conveyance roller group 40.

The conveyance roller group 40 is a general term for the conveyance rollers 41, the timing rollers 42, the secondary transfer roller 43, the fixing rollers 44, and the discharge rollers 45. The sheet sensor group 50 is a general term for the conveyance sensor 51, the timing sensor 52, and the discharge sensor 53.

The multi-feed detection apparatus 3 includes a control board 100, the two movement amount sensors 55 and 56, and a humidity sensor 58.

The control board 100 is configured of a Central Processing Unit (CPU) 101 for executing programs, and a Non-volatile Random Access Memory (NV-RAM) 104 for storing therein various types of data. In addition, the control board 100 is also configured of a Read Only Memory (ROM) for storing programs therein, a RAM used as a work area, and an interface for communicating with an external host device, which are not shown in the drawing.

The CPU 101 performs processing for multi-feed detection and processing related thereto, and also controls the entire operation of the image forming apparatus 1 including the conveyance of the sheet 6.

The humidity sensor 58 detects a humidity H at an installation site of the sheet conveyance apparatus 2, namely, a humidity H under an environment in which the image forming apparatus 1 is used. The humidity H is one of factors influencing the occurrence of multi-feed. Depending on the humidity H detected by the humidity sensor 58, a threshold Q involved in multi-feed detection is set. The result of detection by the humidity sensor 58 may be used also for adjusting conditions of electrophotographic processes in the image forming portion 20.

The description goes on to the detailed configuration and operation of the main part of the sheet conveyance apparatus 2, focusing on multi-feed detection.

Figure 3:
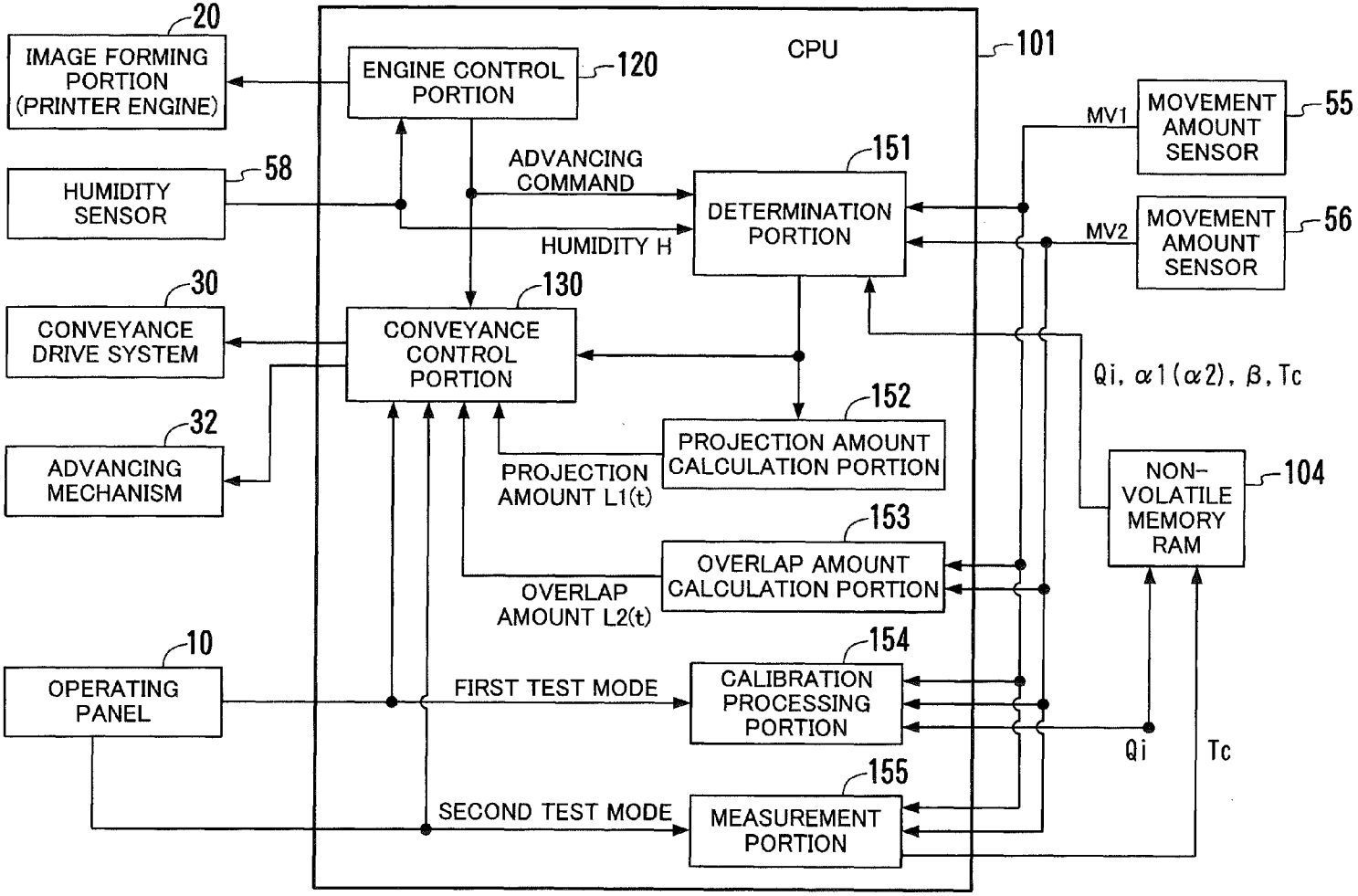
FIG. 3 is a diagram showing an example of the functional configuration of a CPU of a sheet conveyance apparatus.

FIG. 3 shows an example of the functional configuration of the CPU 101 of the sheet conveyance apparatus 2.

The CPU 101 is configured of an engine control portion 120, a conveyance control portion 130, a determination portion 151, a projection amount calculation portion 152, an overlap amount calculation portion 153, a calibration processing portion 154, a measurement portion 155, and so on. The elements are functional elements implemented by executing the programs by the CPU 15.

The engine control portion 120 controls the image forming portion 20. When the image forming apparatus 1 is given a print job, the engine control portion 120 controls the image forming portion 20 to start forming an image, and outputs an advancement command to the conveyance control portion 130 at a predetermined time in accordance with a pace of the image formation. In the case where the number of sheets for the print job is a plural number, the engine control portion 120 outputs the advancement commands corresponding to the number of sheets one after another.

The conveyance control portion 130 is a controller for controlling the advancing mechanism 32 and the conveyance drive system 30. The conveyance control portion 130 is an example of a control unit for controlling the conveyance of the sheet 6 based on the result of determination by the determination portion 151. Every time receiving the advancement command from the engine control portion 120, the conveyance control portion 130 controls the advancing mechanism 32 to advance one sheet.

The determination portion 151 determines that the conveyance state of the sheet 6 is multi-feed when a difference between a movement amount MV1 of the sheet 6 detected by the first movement amount sensor 55 and a movement amount MV2 of the sheet 6 detected by the second movement amount sensor 56 is equal to or greater than the threshold Q. The determination portion 151 then informs the conveyance control portion 130 and the projection amount calculation portion 152 of the determination result.

After the sheet 6 supplied to the paper path 5 reaches the conveyance rollers 41 which are driving rollers, the determination portion 151 does not determine whether or not the conveyance state of the sheet 6 is multi-feed. This is because the two sheets 6 overlapping each other are conveyed at the same speed by the conveyance rollers 41.

The threshold Q related to the determination by the determination portion 151 is a criterion for preventing erroneous determination taking into consideration of a detection error of the movement amounts MV1 and MV2. The threshold Q is set in accordance with the type of the sheet 6, the cumulative usage of the sheet conveyance apparatus 2, and the humidity H of the installation site of the sheet conveyance apparatus 2. The threshold Q is a product of its basic value Qi and coefficients $\alpha$1 (or $\alpha$2) and $\beta$ related to the cumulative usage for each type and the humidity H.

The determination portion 151 detects a length of the sheet 6 based on the movement amount MV1 or MV2 detected by the first movement amount sensor 55 or the second movement amount sensor 56. If the length of the sheet 6 detected is longer than the sum of a length set for the sheet 6 contained in the sheet containing portion 31 and the variation amount thereof, then the determination portion 151 determines that the conveyance state of the sheet 6 is multi-feed.

If the determination portion 151 determines that the conveyance state of the sheet 6 is multi-feed, and further, if a multi-fed successive sheet 6*b* (see FIG. 5) stops, for example, to project toward the downstream with respect to the advancing rollers 36, then the projection amount calculation portion 152 calculates a projection amount L1(*t*) of the successive sheet 6*b*. The projection amount L1(*t*) is calculated based on the time during which the determination portion 151 determines that the conveyance state is multi-feed and on the conveyance speed of the sheet 6.

Upon the calculation of the projection amount L1(*t*), before starting advancing the successive sheet 6*b*, the conveyance control portion 130 delays the time at which the successive sheet 6*b* is advanced by the advancing rollers 36 depending on the projection amount L1(*t*).

If the determination portion 151 determines that the conveyance state of the sheet 6 is multi-feed, then the overlap amount calculation portion 153 calculates an overlap amount L2(*t*) which is the length of the overlap part of the sheets 6 in the multi-feed state based on the movement amount MV1 (or MV2) detected by the first movement amount sensor 55 or the second movement amount sensor 56.

Upon the calculation of the overlap amount L2(*t*) by the overlap amount calculation portion 153, the conveyance control portion 130 controls the conveyance of the sheet 6 in accordance with the calculated overlap amount L2(*t*). For example, the conveyance control portion 130 stops the conveyance when the overlap amount L2(*t*) is greater than a threshold.

In test conveyance of conveying one sheet 6, the calibration processing portion 154 corrects the threshold Q depending on the difference between the movement amount MV1 of the sheet 6 detected by the first movement amount sensor 55 and the movement amount MV2 of the sheet 6 detected by the second movement amount sensor 56. To be specific, when a first test mode is designated in the operating panel 10, the calibration processing portion 154 replaces the basic value Qi (the basic value of the threshold Q) stored in the non-volatile RAM 104 with a value corrected depending on the difference between the movement amounts MV1 and MV2 (for example, a value obtained by adding the difference between the movement amount MV1 and the movement amount MV2 to the current basic value Qi). The correction of the basic value Qi results in correcting the threshold Q substantially.

The first test mode is designated, for example, at the time of maintenance on or after the shipment of the image forming apparatus 1 from a factory. An operator who has designated the first test mode places only one sheet 6 in the sheet containing portion 31, and then presses the start key on the operating panel 10 to start the test conveyance.

In the test conveyance of conveying one sheet 6, the measurement portion 155 measures a detection time lag Tc which is a difference in time at which detection of the movement amounts MV1 and MV2 of the sheet 6 is started between the first movement amount sensor 55 and the second movement amount sensor 56. To be specific, when a second test mode is designated in the operating panel 10, the measurement portion 155 measures a time from when one of detections of the movement amounts MV1 and MV2 starts to when both the detections thereof start, and stores the time measured as the detection time lag Tc into the non-volatile RAM 104.

The detection time lag Tc occurs when the mounting positions of the movement amount sensors 55 and 56 are shifted from each other. The detection time lag Tc stored into the non-volatile RAM 104 is used later by the determination portion 151. To be specific, in conveying the sheet 6 not for the test conveyance, the determination portion 151 determines whether or not the conveyance state of the sheet 6 is multi-feed after the detection time lag Tc measured by the measurement portion 155 has elapsed since the start of the detection of the movement amount MV1 (or MV2) of the sheet 6 by any one of the first movement amount sensor 55 and the second movement amount sensor 55.

Figure 4:
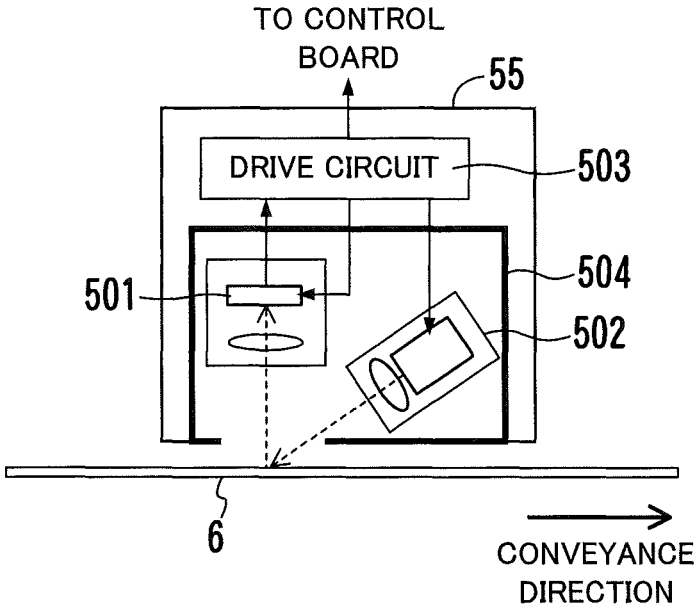
FIG. 4 is a schematic diagram showing an example of the structure of a movement amount sensor.

FIG. 4 schematically shows an example of the structure of the movement amount sensor 55. It is supposed, in this description, that the movement amount sensors 55 and 56 have the same structure, and the structure of the movement amount sensor 55 is described as a representative example. However, it is not always necessary that the movement amount sensors 55 and 56 have the same configuration. The movement amount sensors 55 and 56 have structures different from each other, provided that each of the movement amount sensors 55 and 56 detects the movement amount of the sheet 6.

The movement amount sensor 55 includes an image sensor 501 for imaging a density pattern in a predetermined detection region, a light emitting unit 502 for illuminating the detection region, a drive circuit 503 for driving the image sensor 501 and the light emitting unit 502, and so on. The image sensor 501 and the light emitting unit 502 are accommodated in a housing 504 for preventing influence of outside light. The image sensor 502 is, for example, a CMOS sensor. The light source of the light emitting unit 502 is, for example, a light emitting diode (LED).

The image sensor 501 faces the surface of the sheet 6 which moves in the conveyance direction. The gap therebeteween is, for example, approximately 5-12 millimeters. The light emitting unit 502 applies illumination light onto the surface of the sheet 6 from a position at an angle with the surface of the sheet 6 in such a manner that a shadow corresponding to the uneven surface of the sheet 6 is observed. The illumination light reflects diffusely from the surface of the sheet 6. A part of the illumination light reflecting diffusely is focused by an imaging lens to enter the image sensor 501. Thereby, the shadow corresponding to the uneven surface is imaged as the density pattern.

The drive circuit 503 of the movement amount sensor 55 is provided with a processor for processing on an output from the image sensor 501. The movement amount sensor 55 compares between the density patterns imaged by the image sensor 501 at predetermined intervals of time to detect a movement amount of the sheet 6. The detailed description is provided below.

While being ON by the CPU 101, the movement amount sensor 55 cyclically takes an image of an object within a detection region to obtain a photographed image. Each of the photographed images is an image obtained by imaging a gradation pattern of a rectangular part having each side of, for example, approximately 1-2 millimeters of the object.

When a photographed image is obtained by the first imaging, the movement amount sensor 55 creates a plurality of predicted images by shifting the photographed image, one pixel by one pixel, to one direction. The direction corresponds to the conveyance direction of the sheet 6. The movement amount sensor 55 stores, as a predicted pattern, a part of a predetermined positional range (the center, for example) of each of the photographed image and the plurality of predicted images. The movement amount sensor 55 then waits for the next detection command.

When a photographed image is obtained by the second imaging, the movement amount sensor 55 extracts, from the photographed image, a part of the predetermined positional range as an actual measured pattern. The movement amount sensor 55 then compares between the actual measured pattern and the predicted pattern (pattern matching). The movement amount sensor 55 then sends, to the CPU 101, as the movement amount MV1, a shift amount (number of shifted pixels) with respect to the original photographed image corresponding to a predicted pattern matching the actual measured pattern.

Thereafter, the movement amount sensor 55 stores a plurality of predicted patterns corresponding to the photographed image obtained this time in a manner similar to the foregoing manner.

When a photographed image is obtained by the third imaging and beyond, the movement amount sensor 55 takes an image of the object, performs pattern matching, outputs a movement amount MV1, and then prepares a plurality of predicted patterns for the next detection, as with the second imaging.

Based on the movement amount MV1 detected in this manner, a conveyance speed V6 of the sheet 6 can be calculated. The CPU 101 calculates the conveyance speed V6 based on the movement amount MV1, known pixel pitch information, and an imaging cycle (h). The pixel pitch information shows a distance (L), in the detection region, of a pixel pitch (P) of the photographed image. The conveyance speed V6 is expressed by the following equation.

$$V6[\mathrm{mm/s}]=MV1\times L[\mathrm{mm}]\times(1/\mathrm{h}[\mathrm{ms}])\times 1000$$

For example, when the movement amount MV1 is 2, the distance (d) is 0.1 mm, and the cycle (h) is 2 ms, the conveyance speed V6 is 100 mm/s.

Another detection operation is possible in which a single predicted pattern is stored and the predicted pattern is compared with the actual measured pattern. In such a case, the movement amount sensor 55 stores a predicted pattern created by shifting the photographed image by one pixel, then takes images at a short cycle (for example, 80-100 □s), and compares between the predicted pattern and the actual measured pattern obtained for each photographing. Such a comparison is repeated at the cycle until both the patterns match each other.

If there is a match between the predicted pattern and the actual measured pattern, then the movement amount sensor 55 creates again a predicted pattern based on the matched actual measured pattern and stores the predicted pattern created, and also stores, as the movement amount MV1, the number of times of comparison made so far. In short, a time corresponding to how many cycles is taken for movement by a distance corresponding to one pixel. The movement amount MV1 stored in this way is updated every time a match is found between compared patterns. When the CPU 101 gives a command to output the detection result, the movement amount sensor 55 outputs, to the CPU 101, data indicating the latest movement amount MV1 stored.

Instead of taking an image of a shadow corresponding to the uneven surface of the sheet 6 as the gradation pattern, a laser beam may be applied to take an image of an interference fringe corresponding to the uneven surface of the sheet 6 as the gradation pattern. In such a case, the movement amount sensor 55 is provided with, as the light source of the light emitting unit 502, a semiconductor laser, for example.

The movement amount sensors 55 and 56 are not limited to the type of imaging the density pattern. One or both of the movement amount sensors 55 and 56 may be another type of sensor. For example, a laser interference Doppler type sensor may be used to detect the movement amount. In the laser interference Doppler type sensor, two laser beams are applied to two positions adjacent on the detection surface along the movement direction, and scattered light reflecting from the detection surface is received. The scattered light has speed information caused by Doppler effect that the wavelength is short at a position on the front side and the wavelength is long at a position on the rear side. The sensor performs a heterodyne detection on a received light signal to detect the difference in wavelength as the speed information.

Figure 5:
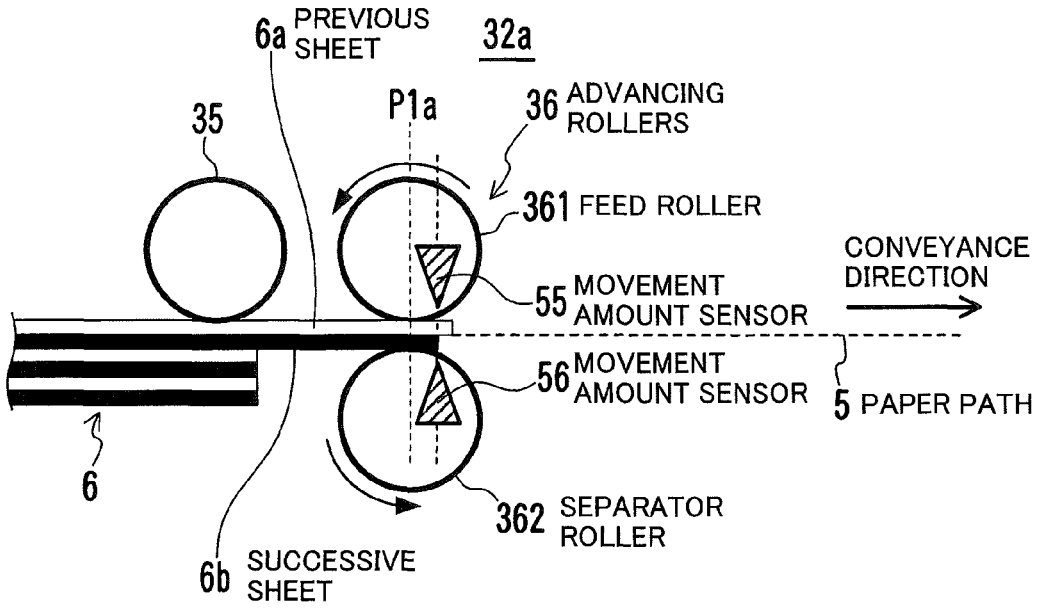
FIG. 5 is a diagram showing the structure of a first example of an advancing mechanism and a layout example of movement amount sensors.

FIG. 5 shows the structure of a first example of the advancing mechanism 32 and a layout example of the movement amount sensors 55 and 56. FIG. 5 depicts how to advance sheets 6 in a multi-feed state.

The advancing mechanism 32 according to the first example is an advancing mechanism 32*a* of reverse separation type. The advancing mechanism 32*a* is provided with the pickup roller 35 and the advancing rollers 36. The pickup roller 35 is to take the sheet 6 out of the sheet containing portion 31. The advancing rollers 36 include a feed roller 361 for sending the sheet 6 taken by the pickup roller 35 to the paper path 5 and a separator roller 362 rotatable in the direction opposite to the conveyance direction of the feed roller 361. The separator roller 362 contains therein a torque limiter for causing the separator roller 362 to rotate in the direction opposite to the conveyance direction when excessive torque is given.

In normal advancing, the pickup roller 35 takes out one sheet 6 to send the sheet 6 to a nip position P1*a* of the advancing rollers 36. Then, the feed roller 361 rotates in a counterclockwise direction shown in FIG. 5, so that the sheet 6 is sent to the paper path 5. At this time, the separator roller 362 rotates in a clockwise direction so as to follow the feed roller 361 due to the friction against the sheet 6. The rotation is made in the conveyance direction, which does not prevent the sheet 6 from advancing.

Even if two sheets 6 overlapping each other are delivered to the nip position of the advancing rollers 36, the two sheets 6 are usually separated from each other by the separator roller 362 in an appropriate manner. In such a case, torque on the advancing rollers 36 is large, so that the separator roller 362 rotates in the direction opposite to the conveyance direction. This prevents, of the two sheets 6, the bottom sheet 6 contacting the separator roller 362, namely, a successive sheet 6*b*, from advancing by the separator roller 362, and only the top sheet 6 not contacting the separator roller 362, namely, the previous sheet 6*a*, is sent to the paper path 5 in association with the rotation of the feed roller 361.

However, a frictional force between the previous sheet 6*a* and the successive sheet 6*b* is probably larger than that between the separator roller 362 and the successive sheet 6*b*. In such a case, although the separator roller 362 rotates in the direction opposite to the conveyance direction, the successive sheet 6*b* is dragged by the previous sheet 6*a*, and is advanced to the paper path 5 with the previous sheet 6*a* on the successive sheet 6*b*. In short, multi-feed occurs.

In this multi-feed, the previous sheet 6*a* and the successive sheet 6*b* differ from each other in movement speed. The movement speed of the previous sheet 6*a* is larger than that of the successive sheet 6*b*. This is because the force, by the separator roller 362 rotating in the direction opposite to the conveyance direction, of reversing the sheet 6 works on the successive sheet 6*b*, and such a force does not work on the previous sheet 6*a*.

In the illustrated example of FIG. 5, the first movement amount sensor 55 and the second movement amount sensor 56 are disposed in the vicinity of the downstream on the paper path 5 with respect to the nip position P1*a* of the advancing rollers 36. When one sheet or a plurality of sheets overlapping one another pass through a gap between the movement amount sensors 55 and 56, the first movement amount sensor 55 faces a surface of the sheet 6 which contacts the feed roller 361, and the second movement amount sensor 56 faces a surface of the sheet 6 which contacts the separator roller 362.

Comparing between the results of detection by the movement amount sensors 55 and 56 disposed as described above makes it possible to detect multi-feed.

When the sheet 6 is normally advanced, the movement amount sensors 55 and 56 face the front and rear of the sheet 6. In such a case, the results of detection by the movement amount sensors 55 and 56 have the identical value.

On the other hand, in occurrence of multi-feed, when an overlap part of the previous sheet 6*a* and the successive sheet 6*b* passes, the movement amount sensors 55 and 56 face the previous sheet 6*a* and the successive sheet 6*b*, respectively. As described above, the movement speed is different between the previous sheet 6*a* and the successive sheet 6*b*, so that the results of detection by the movement amount sensors 55 and 56 are different from each other.

Thus, such a state in which the results of detection by the movement amount sensors 55 and 56 are different from each other is detected as multi-feed.

Figure 6A:
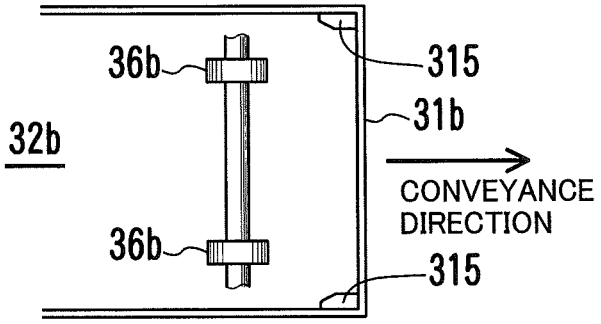
FIG. 6A is a top view of the structure a second example of an advancing mechanism and FIG. 6B is a diagram showing operation of separating sheets.
Figure 6B:
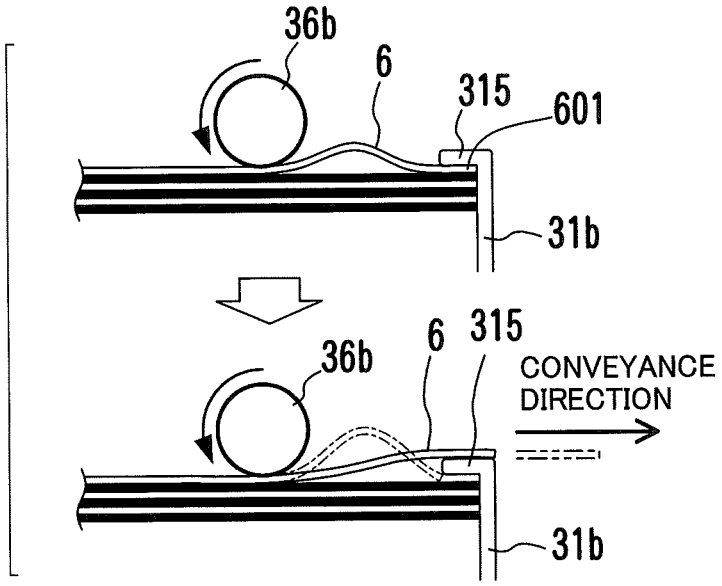
Figure 7:
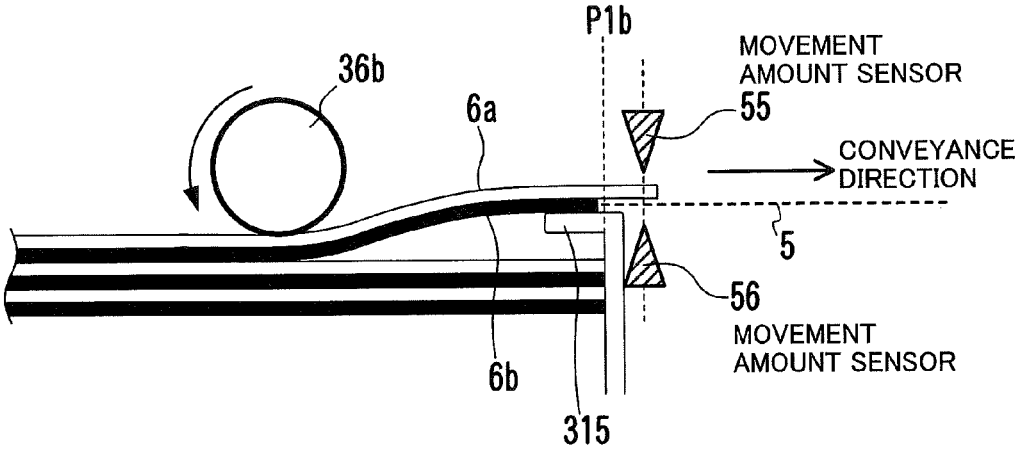
FIG. 7 is a diagram showing a layout example of movement amount sensors in the vicinity of the second example of an advancing mechanism.

FIG. 6A is a top view of the structure of a second example of the advancing mechanism 32; FIG. 6B is a diagram showing operation of separating the sheets 6 in the second example of the advancing mechanism 32; and FIG. 7 shows a layout example of the movement amount sensors 55 and 56 in the vicinity of the second example of the advancing mechanism 32.

The advancing mechanism 32 according to the second example is an advancing mechanism 32*b* of corner claws separation type. The advancing mechanism 32*b* is provided with pickup rollers 36*b* for taking the sheet 6 out of a sheet containing portion 31*b* and a pair of corner claws 315 provided in the sheet containing portion 31*b*. As shown in FIG. 6A, the corner claws 315 are disposed at the corners of the sheet containing portion 31*b* on the front side in the conveyance direction. As shown in FIG. 6B, the corner claws 315 catch corner parts 601 of the advancing end of the sheet 6 supplied by the pickup rollers 36*b* to warp the sheet 6.

A plurality of sheets 6 is stacked and held in the sheet containing portion 31*b* in such a manner that the sheets 6 contact the inner wall surface on the front side of the sheet containing portion 31*b*. The corner claws 315 are above the corner parts 601 of the sheet 6.

In normal advancing, only one sheet 6 which is held in the top of sheets 6 in the sheet containing portion 31*b* is pressed toward the conveyance direction in association with the rotation of the pickup rollers 36*b* to start being warped. As the sheet 6 is further warped, the sheet 6 moves backward, and the front end thereof moves out from below the corner claws 315. Then, the sheet 6 returns to be flat due to the elasticity, so that the front end of the sheet 6 is placed on the corner claws 315. After that, the sheet 6 passes on the corner claws 315 to be sent to the paper path 5.

In some cases, among the sheets held in the sheet containing portion 31*b*, not the top sheet 6 (the first sheet) but both the top sheet 6 and the sheet 6 immediately therebelow (the second sheet) are warped. Stated differently, the top sheet 6 sent out due to the rotation of the pickup rollers 36*b* drags the sheet 6 immediately below the top sheet 6. In such a case, as shown in FIG. 7, the previous sheet 6*a* which is the top sheet 6, and the successive sheet 6*b* which is the sheet 6 dragged by the top sheet 6 pass above the corner claws 315 to go to the paper path 5. In short, multi-feed occurs.

In this multi-feed, the frictional force between the successive sheet 6*b* and the sheet 6 immediately therebelow (the third sheet) works as a force for preventing the successive sheet 6*b* from moving. Therefore, the movement speed of the previous sheet 6*a* is larger than of the successive sheet 6*b*.

In the illustrated example of FIG. 7, the first movement amount sensor 55 and the second movement amount sensor 56 are disposed in the vicinity of the downstream on the paper path 5 with respect to a position P1*b* at which the corner claw 315 is provided. The multi-feed detection apparatus 3 can detect multi-feed shortly after the occurrence thereof based on the results of detection by the movement amount sensors 55 and 56.

Figure 8:
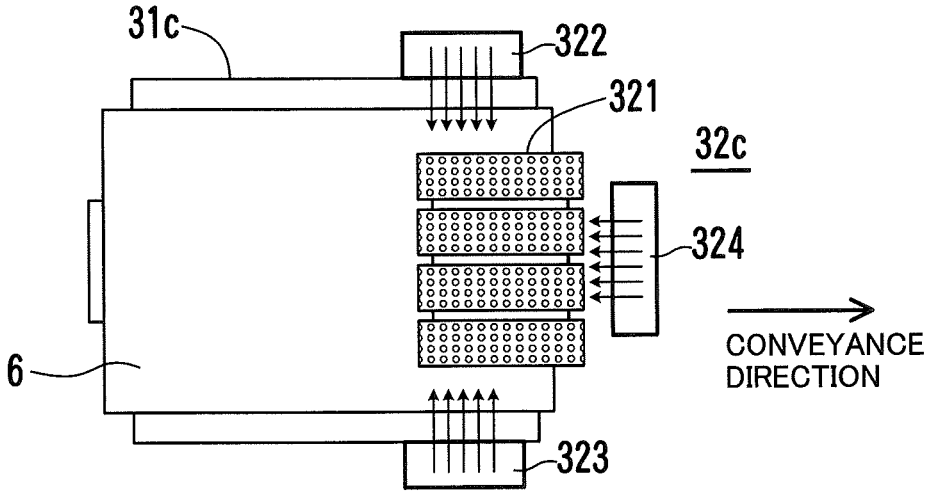
FIG. 8 is a top view of the structure of a third example of an advancing mechanism.
Figure 9:
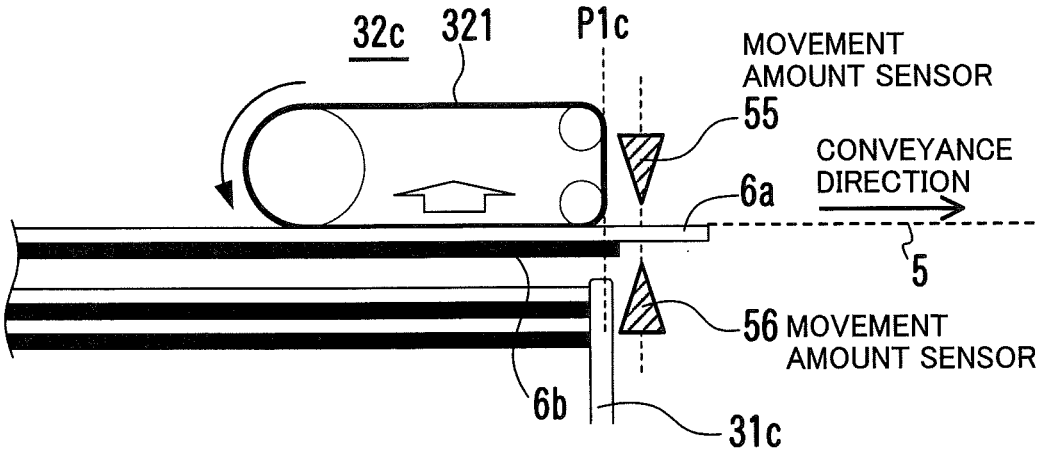
FIG. 9 is a diagram showing a layout example of movement amount sensors in the vicinity of the third example of an advancing mechanism.

FIG. 8 is a top view of the structure of a third example of the advancing mechanism 32. FIG. 9 shows a layout example of the movement amount sensors 55 and 56 in the vicinity of the third example of the advancing mechanism 32.

The advancing mechanism 32 according to the third example is an advancing mechanism 32*c* of air separation type. The advancing mechanism 32*c* is provided with an advancing belt 321, float fans 322 and 323, and a separator fan 324.

The advancing belt 321 is disposed above a sheet containing portion 31*c*. The advancing belt 321 adsorbs the topmost sheet 6 held in the sheet containing portion 31*c* by a negative pressure to send the adsorbed sheet 6 to the paper path 5.

The float fans 322 and 323 blow air onto a bundle of the sheets 6 held in the sheet containing portion 31*c* from both sides of the sheets 6 in the width direction thereof orthogonal to the conveyance direction. The separator fan 324 blows air onto the bundle of the sheets 6 held in the sheet containing portion 31*c* from the front side in the conveyance direction.

For the advancement by the advancing mechanism 32*c*, the float fans 322 and 323, and the separator fan 324 are first operated to float one or more sheets 6. In parallel with this operation, a negative pressure is generated inside the advancing belt 321 to adsorb the topmost sheet 6 to the outer surface of the advancing belt 321. Then, the float fans 322 and 323 are stopped with the separator fan 324 remaining operated, and the sheet 6 not adsorbed to the advancing belt 321 is dropped. Then, a roller wound with the advancing belt 321 is rotated to send the sheet 6 to the paper path 5. At this time, the separator fan 324 is operated to separate the sheet 6 until the end of the sheet 6 passes through a position of an air outlet of the separator fan 324. Through this operation, one sheet 1 is usually advanced.

However, a sheet 6 immediately below the topmost sheet 6 possibly adheres to the topmost sheet 6. In such a case, the previous sheet 6*a* which is the topmost sheet 6 and the successive sheet 6*b* which is a sheet adhering thereto is advanced to the paper path 5 as shown in FIG. 9. In short, multi-feed occurs.

In this multi-feed, the air blow by the separator fan 324 works as a force for pushing back the successive sheet 6*b*. The conveyance force by the advancing belt 321 is exerted directly on the previous sheet 6*a*, and is not exerted directly on the successive sheet 6*b*. Therefore, the movement speed of the previous sheet 6*a* is larger than that of the successive sheet 6*b*.

In the illustrated example of FIG. 9, the first movement amount sensor 55 and the second movement amount sensor 56 are disposed in the vicinity of the downstream on the paper path 5 with respect to a leading end position P1*c* of the advancing belt 321. This allows the multi-feed detection apparatus 3 to detect multi-feed shortly after the occurrence thereof based on the results of detection by the movement amount sensors 55 and 56.

Figure 11:
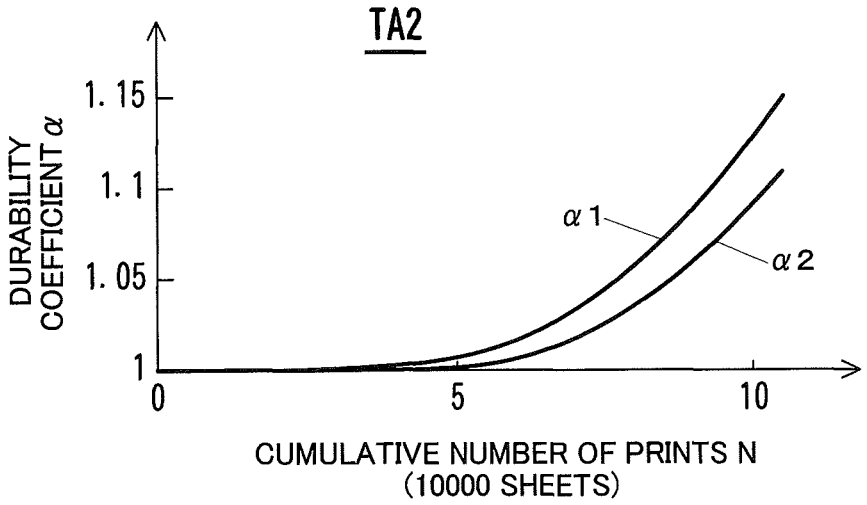
FIG. 11 is a graph showing an example of the relationship between a cumulative usage of a sheet conveyance apparatus and a durability coefficient.

The description now goes on to setting of the threshold Q used for multi-feed detection with reference to FIGS. 10-12.

FIG. 10 shows an example of a table TA1 in which durability coefficients □1 and □2 and a humidity coefficient β related to the threshold Q used for multi-feed detection are set in accordance with the types of sheet 6. FIG. 11 shows an example of the relationship between a cumulative usage of the sheet conveyance apparatus 2 and the durability coefficients □1 and □2. FIG. 12 shows an example of a table TA3 used for setting the humidity coefficient β in accordance with the humidity H.

Referring to the table TA1 of FIG. 10, the sheet 6 is classified based on a paper type into a "thick paper" and a "plain paper". The thick paper corresponds to the durability coefficient □1, and the plain paper corresponds to the durability coefficient α2. The humidity coefficient β corresponds to each of the thick paper and the plain paper.

The durability coefficients □1 and □2 are coefficients to improve the accuracy of detection by reflecting the aging of slip amounts of rollers related to conveyance of the sheet 6 in the multi-feed detection. The durability coefficients □1 and □2 are variables depending on a cumulative number of prints N as shown in FIG. 11. The cumulative number of prints N is accumulation of the number of sheets 6 used in the image forming apparatus 1. The cumulative number of prints N is counted up, for example, in response to discharge of the sheet 6, and is stored in the non-volatile memory 104. The cumulative number of prints N is an example of cumulative usage of the sheet conveyance apparatus 2.

The relationship between the durability coefficients □1 and □2 and the cumulative number of prints N may be determined in advance through experiments. The experiment is, for example, to find a difference between the detection result by the movement amount sensor 55 and the detection result by the movement amount sensor 56 for the case where multi-feed occurs under different conditions having different values of cumulative number of prints N, and to determine a correction amount of the basic value Qi as the durability coefficients □1 and □2.

Referring to FIG. 11, the relationship between the durability coefficients □1 and □2 and the cumulative number of prints N is shown in the form of a graph. In practical cases, the non-volatile RAM 104 preferably stores the table TA2 in which the values of the durability coefficients □1 and □2 correspond to each value of the cumulative number of prints N.

The humidity coefficient β is a coefficient to improve the accuracy of detection by reflecting the change in slip amount of the rollers due to the humidity H in the multi-feed detection. Referring to the table TA3 of FIG. 12, potential values (0-100%) of the humidity H are classified into three ranges, and a value of the humidity coefficient β is preset for each of the ranges. The content of the table TA3 may be defined based on the result obtained by conducting an experiment. The experiment is to find a difference between the detection result by the movement amount sensor 55 and the detection result by the movement amount sensor 56 for the case where multi-feed occurs under different conditions having different values of humidity H, and to determine a correction amount of the basic value Qi as the humidity coefficient β.

The determination portion 151 for detecting multi-feed obtains the type of the sheet 6 designated by the user, the latest value of the cumulative number of prints N stored in the non-volatile RAM 104, and the value of the humidity H detected by the humidity sensor 58. The determination portion 151 then refers to the tables TA1, TA2, and TA3 stored in the non-volatile RAM 104 to calculate the threshold Q. After that, if the difference between the result of detection by the movement amount sensor 55 and the result of detection by the movement amount sensor 56 is equal to or greater than the threshold Q calculated, then the determination portion 151 determines that the conveyance state of the sheet 6 is multi-feed.

Where the type of the sheet 6 used for execution of a print job is "thick paper", the threshold Q is calculated based on, for example, the following equation.

$$\text{Threshold } Q = \text{basic value } Qi \times \text{durability coefficient} \cdot 1 \times \text{humidity coefficient } \beta$$

Where the type of the sheet 6 used for execution of a print job is "plain paper", the threshold Q is calculated based on, for example, the following equation.

$$\text{Threshold } Q = \text{basic value } Qi \times \text{durability coefficient } \alpha 2 \times \text{humidity coefficient } \beta$$

The description goes on to the operation by the sheet conveyance apparatus 2 with reference to flowcharts.

Figure 13:
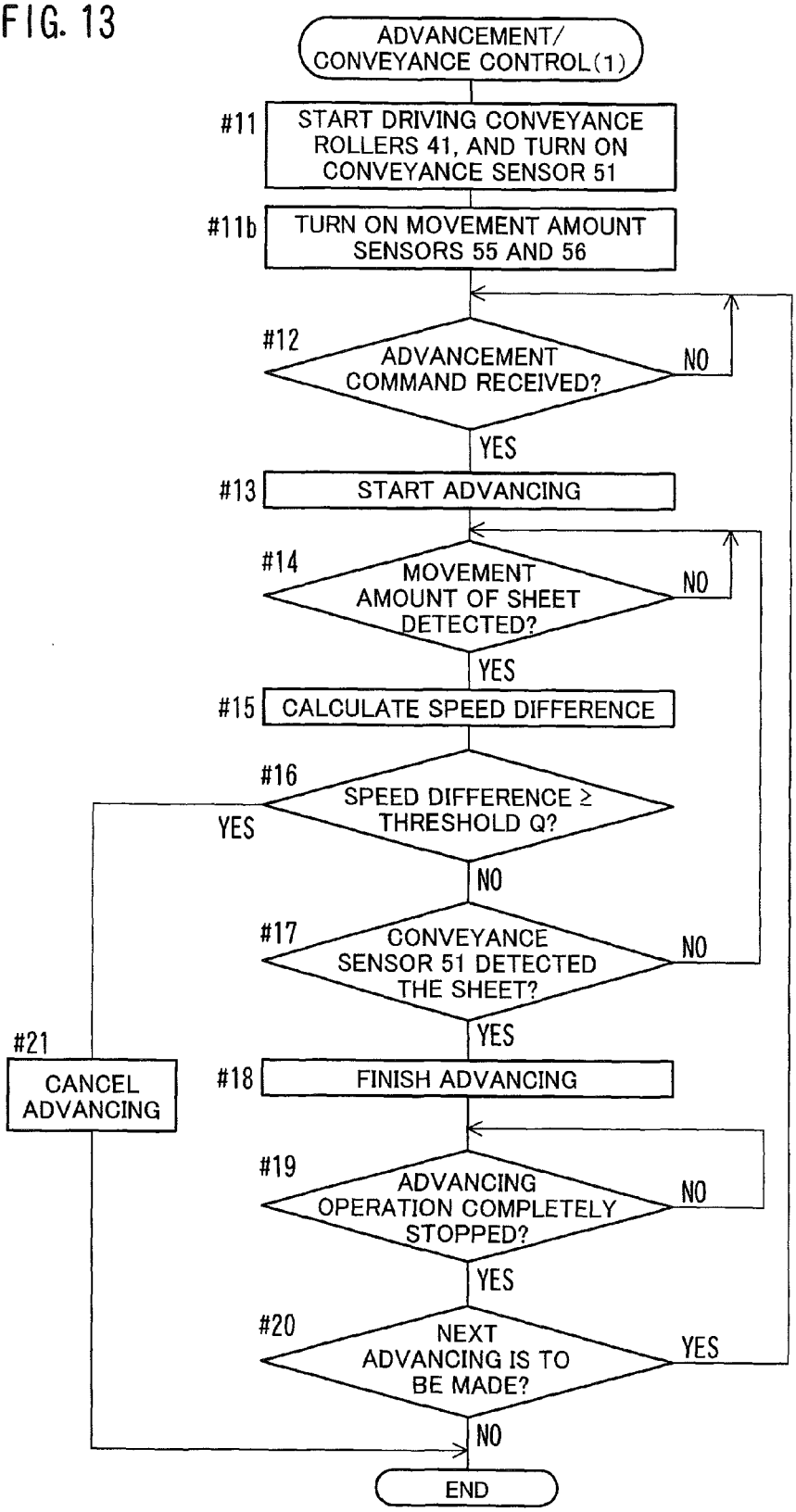
FIG. 13 is a flowchart for depicting a first example of advancement/conveyance control in a sheet conveyance apparatus.

FIG. 13 depicts a first example of advancement/conveyance control in the sheet conveyance apparatus 2. The first example is an example in which advancing the sheet is cancelled immediately after multi-feed is detected.

Referring also to FIGS. 1-3, when the image forming apparatus 1 is given a print job, the conveyance control portion 130 of the CPU 101 rotates the motor 302 for driving the conveyance roller group 40 to start driving the conveyance rollers 41, and also turns ON the conveyance sensor 51 (Step #11). Turning ON the conveyance sensor 51 means switching the state of the sensor from a detection stop state (OFF) to a detectable state (ON). Switching the state of the sensor from ON to OFF is sometimes referred to as "turning OFF" the sensor. The same is similarly applied to the other sensors.

After that, the conveyance control portion 130 turns ON the movement amount sensors 55 and 56 (Step #11*b*).

The conveyance control portion 130 waits for an advancement command from the engine control portion 120 (Step #12). Upon receipt of the advancement command (YES in Step #12), the conveyance control portion 130 controls the advancing mechanism 32 to start advancing the sheet 6 (Step #13).

The determination portion 151 waits for the movement amount sensors 55 and 56 to detect the movement amounts MV1 and MV2 of the sheet 6 (Step #14). When the movement amounts MV1 and MV2 are detected (YES in Step #14), the determination portion 151 calculates a speed difference which is the difference between the movement amounts MV1 and MV2 (Step #15).

The determination portion 151 then checks whether or not the speed difference calculated is equal to or greater than the threshold Q (Step #16). The threshold Q used at this time is one calculated by the determination portion 151 based on the foregoing equation with reference to the tables TA1, TA2, and TA3 during a period between the type of the sheet 6 found and the present.

If the speed difference is equal to or greater than the threshold Q (YES in Step #16), then the determination portion 151 determines that the conveyance state of the sheet 6 is multi-feed. The determination portion 151 then informs the conveyance control portion 130 that multi-feed is detected. In response to the information, the conveyance control portion 130 controls the advancing mechanism 32 to promptly cancel advancing the sheet 6 (Step #21). Then, the processing is finished. In such a case, the image forming apparatus 1 displays an error message to inform the user of a paper jam, and waits for the user to remove the sheet 6 remaining on the paper path 5.

On the other hand, if the speed difference is smaller than the threshold Q (NO in Step #16), then advancing the sheet 6 continues. In such a case, the conveyance control portion 130 checks whether or not the conveyance sensor 51 has detected the sheet 6 (Step #17).

If the conveyance sensor 51 has not detected the sheet 6 (NO in Step #17), then the processing goes back to Step #14. To be specific, the processing for detecting multi-feed (Step #14-Step #16) is repeatedly performed during a period from when advancing the sheet 6 is started in Step #13 to when the conveyance sensor 51 detects the sheet 6.

If the leading end of the advanced sheet 6 reaches the position of the conveyance sensor 51 and the conveyance sensor 51 detects the sheet 6 (YES in Step #17), then the conveyance control portion 130 controls the advancing mechanism 32 to finish the advancing operation (Step #18). For example, when the advancing mechanism 32*a* of FIG. 5 is used as the advancing mechanism 32, driving the advancing rollers 36 is stopped. In Step #18, the sheet 6 has already reached the conveyance rollers 41. The sheet 6 is thus conveyed by the conveyance rollers 41 even when the advancing operation is finished.

If the advancing operation is completely finished (YES in Step #19), then the conveyance control portion 130 checks whether or not the next advancing is to be made (Step #20). To be specific, the conveyance control portion 130 checks whether or not the sheets 6 corresponding to the number of prints designated in the print job have been advanced. The check may be made, for example, as follows: the number of times of execution in Step #18 is counted in advance. When the count value is smaller than the designated value for the number of prints, it is determined that the next advancing is to be made.

If the next advancing is to be made (YES in Step #20), then the processing goes back to Step #12. If no next advancing is to be made (NO in Step #20), then the flow of processing is finished.

Figure 14:
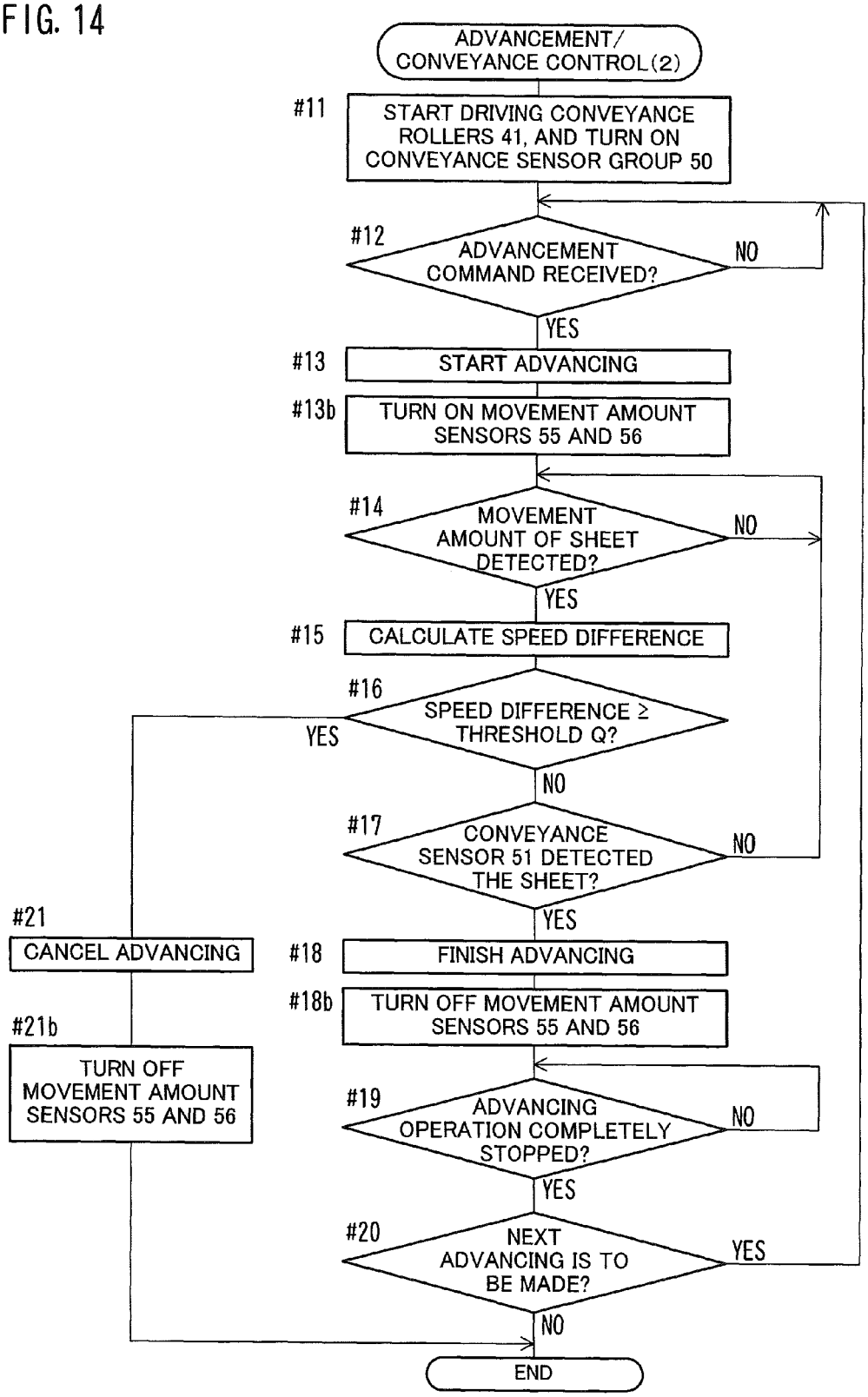
FIG. 14 is a flowchart for depicting a second example of advancement/conveyance control in a sheet conveyance apparatus.

FIG. 14 depicts a second example of advancement/conveyance control in the sheet conveyance apparatus 2. As with the first example, in the second example, advancing the sheet 6 is cancelled promptly when multi-feed is detected. In FIG. 14, steps that are same as those in FIG. 13 are identified with the identical step number, and the description thereof will be omitted or will be simplified.

The differences between the second example in FIG. 14 and the first example in FIG. 3 are: a time at which the movement amount sensors 55 and 56 are turned ON; and, in the second example, processing of turning OFF the movement amount sensors 55 and 56 is added. The details thereof will be described below.

In the first example, before the advancement command is received, the movement amount sensors 55 and 56 are turned ON (#11*b* of FIG. 13). In contrast, according to the second example, after advancing a sheet is started in response to an advancement command received, the movement amount sensors 55 and 56 are turned ON (#13*b* of FIG. 14).

In the second example, the advancing mechanism 32 is controlled to finish the advancing operation in Step #18, and then, the movement amount sensors 55 and 56 are turned OFF (Step #18*b*). This is because, after the conveyance by the conveyance rollers 41 is started, the results of detection by the movement amount sensors 55 and 56 are the same as each other, which eliminates the need for detection of the movement amount.

After the advancing is cancelled in Step #21, the movement amount sensors 55 and 56 are turned OFF (Step #21*b*). This is because the multi-feed has been already detected, and continuing the detection of movement amount is unnecessary.

The ON/OFF control on the movement amount sensors 55 and 56 is performed as discussed above. This minimizes the period during which the movement amount sensors 55 and 56 are kept ON, so that unnecessary power consumption by the movement amount sensors 55 and 56 are reduced.

Figure 15:
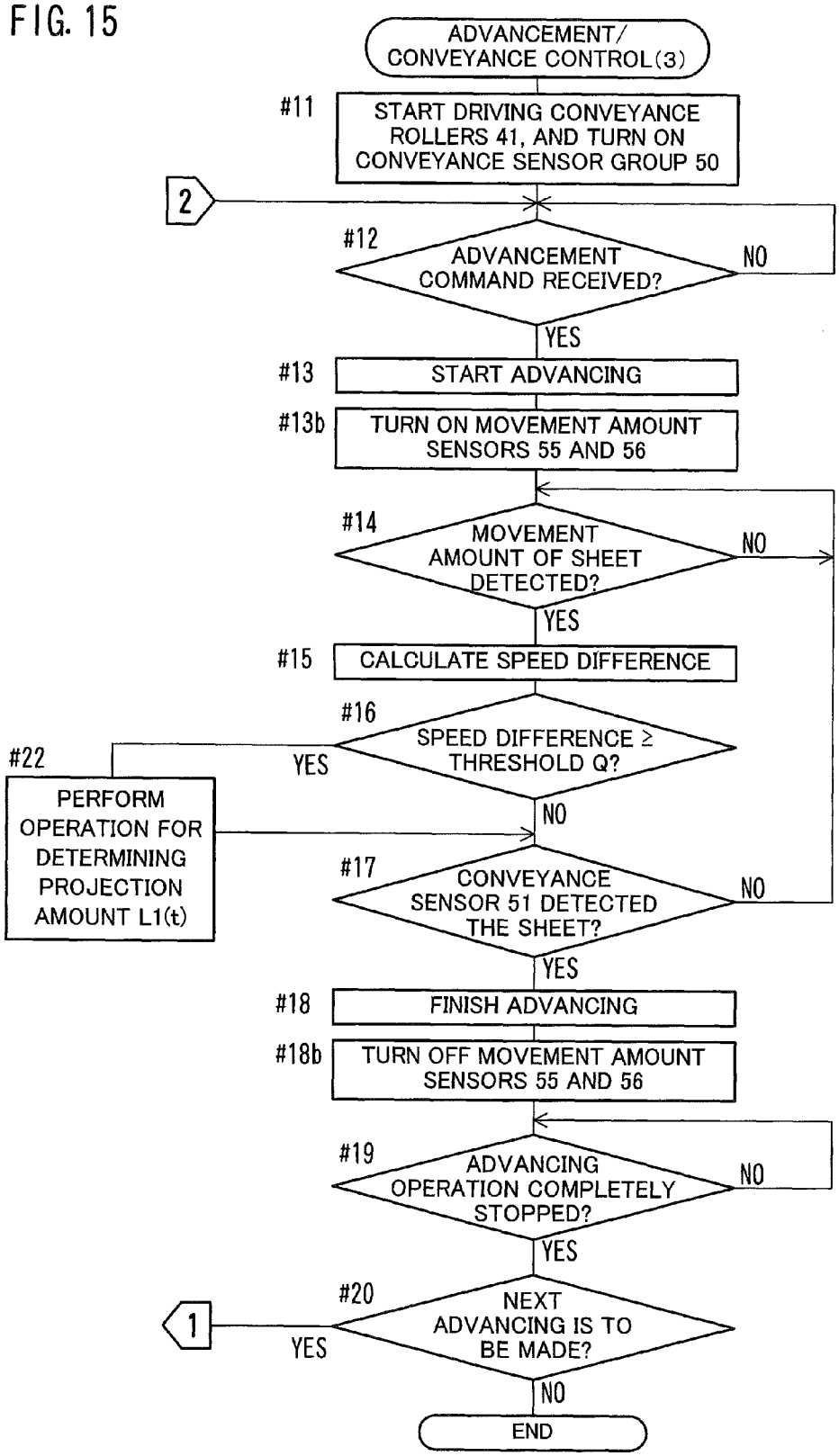
FIG. 15 is a flowchart for depicting a third example of advancement/conveyance control in a sheet conveyance apparatus.
Figure 16:
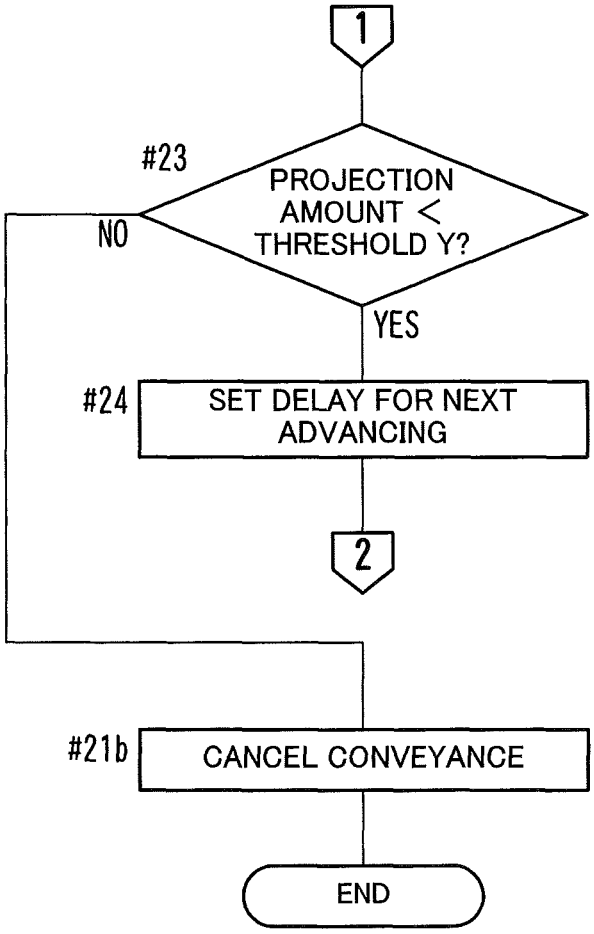
FIG. 16 is a flowchart for depicting a fourth example of advancement/conveyance control in a sheet conveyance apparatus.

FIGS. 15 and 16 depict a third example of advancement/conveyance control in the sheet conveyance apparatus 2. In the third example, when multi-feed is detected, advancing a sheet is not cancelled but continues, unlike the first example and the second example. The basic flow of the third example is, however, similar to the second example in FIG. 14. In FIGS. 15 and 16, steps that are same as those in FIG. 14 are identified with the identical step numbers, and the description thereof will be omitted or will be simplified.

In the third example, if the speed difference is equal to or greater than the threshold Q in Step #16 and the determination portion 151 determines that the conveyance state is multi-feed, in short, if multi-feed is detected, then the projection amount calculation portion 152 performs operation for determining a value of the projection amount L1(*t*) at this time (Step #22).

The projection amount L1(*t*) is a distance between the start position of advancement of the sheet 6 (start point of the paper path 5) and position of the leading end of the sheet 6 advanced. The start position of advancement is, for example, the nip position P1*a* of the advancing rollers 36 of the advancing mechanism 32*a* in FIG. 5, the positions P1*b* at which the corner claws 315 are provided in the advancing mechanism 32*b* of FIG. 7, or the leading end position P1*c* of the advancing belt 321 of the advancing mechanism 32*c* of FIG. 8. The projection amount L1(*t*) is greater as advancing the sheet is progressed.

The processing goes from Step #22 to Step #17. In Step #17, the conveyance control portion 130 checks whether or not the conveyance sensor 51 has detected the sheet 6. If the conveyance sensor 51 has not detected the sheet 6 (NO in Step #17), then the processing returns to Step #14.

Stated differently, even if multi-feed is detected in Step #16, advancing the sheet 6 is continued. The presence/absence of multi-feed is determined at intervals while the advancing is continued (Step #14-Step #16). Every time multi-feed is detected, the operation in Step #22 is performed to update the projection amount L1(*t*) while advancing the sheet 6 is continued.

The post-update projection amount L1(*t*) is expressed by the following equation.

$$\text{Projection amount } L1(t) = \text{Projection amount } L1(t-1) + \text{movement amount } MV2 \times \text{elapsed time } t$$

wherein the Projection amount L1(*t*−1) represents a value of the projection amount L1(*t*) before the update, and the initial value represents the distance from the start position P1*a*, P1*b*, and P1*c* of the advancement to the positions of the movement amount sensors 55 and 56. The movement amount MV2 represents the movement amount of the successive sheet 6*b* detected by the second movement amount sensor 56. The elapsed time t represents a time between the previous operation and the current operation.

In the meantime, if the result in Step #17 is "YES", then the conveyance control portion 151 controls the advancing mechanism 32 to finish the advancing operation (Step #18). As discussed above, even when the advancing operation is finished, the conveyance by the conveyance rollers 41 still continues. However, if the successive sheet 6*b* does not reach the conveyance rollers 41 at a time when the multi-feed occurs and the advancing operation is finished, then the previous sheet 6*a* is conveyed, and the successive sheet 6*b* stops with a part thereof extending from the start positions P1*a*, P1*b*, and P1*c* of the advancement.

The processing goes Step #18, Step #18*b*, Step #19, and goes to Step #20. When the next advancing is not to be made in Step #20 (NO in Step #20), then the processing is finished. When the next advancing is to be made (YES in Step #20), the processing goes to Step #23 of FIG. 16.

In Step #23, the conveyance control portion 130 checks whether or not the projection amount L1(*t*) is smaller than a threshold Y. The threshold Y is a value based on which a determination as to whether the successive sheet 6*b* is to be advanced next. The threshold Y is set to be a value falling within a range which is smaller than a distance between the advancement start position P1*a*, P1*b*, or P1*c* and the position of the conveyance rollers 41. Such a distance is referred to as an "advancement distance".

If the projection amount L1(*t*) is not smaller than the threshold Y (NO in Step #23), then the conveyance control portion 130 controls the conveyance drive system 30 to cancel the conveyance of the sheet 6 (Step #21*b*). For example, when the advancement distance is set as the threshold Y, the truth that the projection amount L1(*t*) is not smaller than the threshold Y means that the successive sheet 6*b* is to be conveyed without being stopped after the advancing operation is finished. Therefore, the conveyance is cancelled to stop the successive sheet 6*b* which is not to be conveyed.

In contrast, if the projection amount L1(*t*) is smaller than the threshold Y (YES in Step #23), then the conveyance control portion 130 sets a delay for the next advancing (Step #24). To be specific, a reparation is so performed that the stopped successive sheet 6*b* is set as the target for the next advancing, before starting advancing the successive sheet 6*b* in response to the next advancing command received, and the time for advancing is delayed compared to the normal time in accordance with the projection amount. An example of the processing is described later.

The processing goes from Step #24 to Step #12 of FIG. 15. In such a case, the conveyance control portion 130 controls, in Step #13, the advancing mechanism 32 at a time set in Step #24. If the advancing mechanism 32*a* of FIG. 5 is used as the advancing mechanism 32, then taking out the sheet 6 by the pickup roller 35 may be omitted according to needs.

Figure 17:
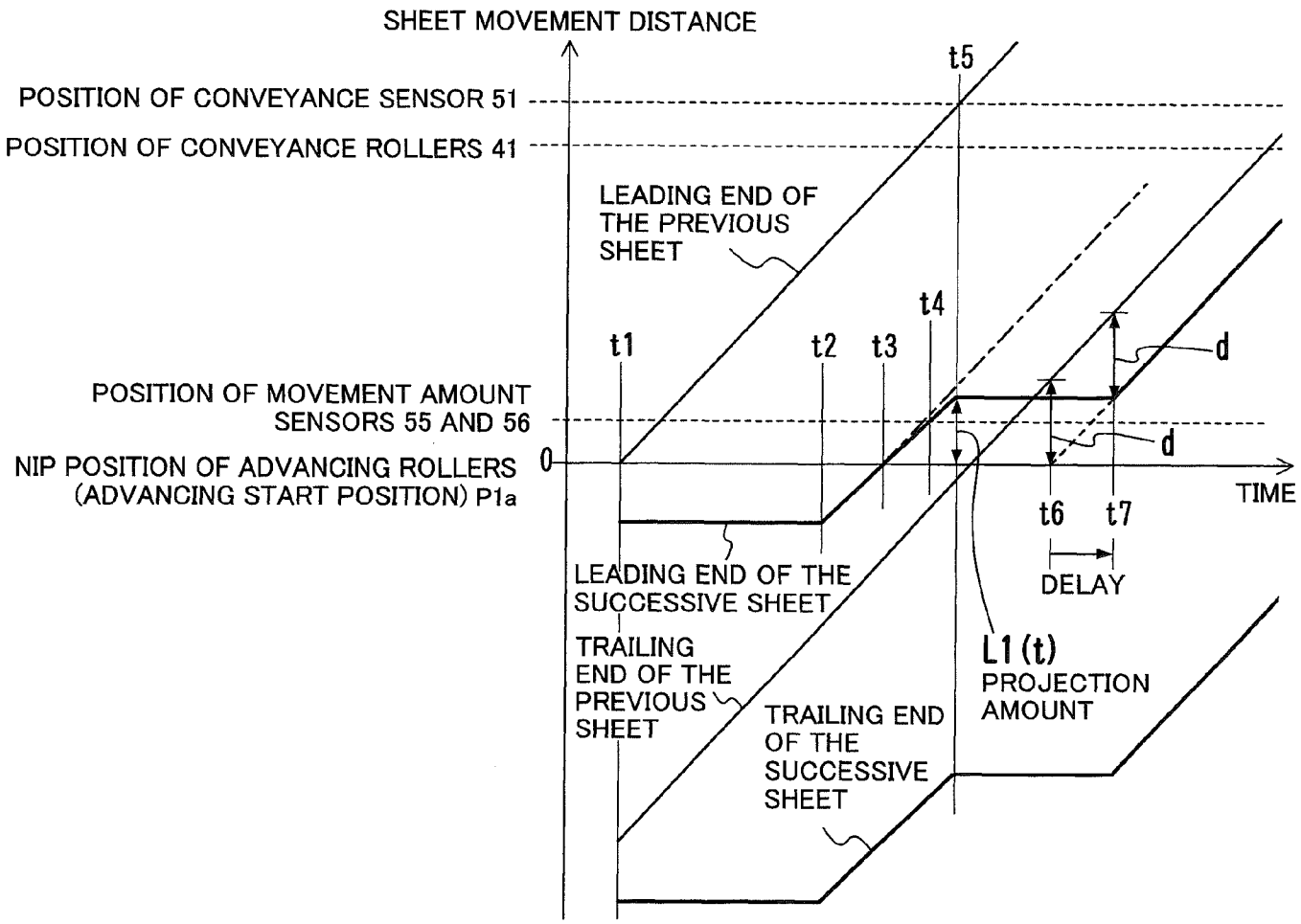
FIG. 17 is a diagram showing an example of advancement control in accordance with a projection amount of a sheet.

FIG. 17 shows an example of advancement control in accordance with a projection amount of the sheet 6. In the illustrated example, it is supposed that the advancing mechanism 32*a* of FIG. 5 is used as the advancing mechanism 32, and the start position of the advancement is the nip position P1*a* of the advancing rollers 36.

FIG. 17 exemplifies a transition of position of each of the leading and trailing ends of the previous sheet 6*a* and the successive sheet 6*b*. The horizontal axis represents time, and the vertical axis represents a distance away from the nip position P1*a* of the advancing rollers 36.

Referring to FIG. 17, at the time point t1, the leading end of the previous sheet 6*a* is on the nip position P1*a* of the advancing rollers 36. At the time point t1, the advancing rollers 36 are driven to start advancing the previous sheet 6*a*. Thereafter, the previous sheet 6*a* moves at a constant speed.

At the time point t1, the leading end of the successive sheet 6*b* is positioned in the upstream of the nip position P1*a*, and the successive sheet 6*b* stops.

At the time point t2, the advancing operation of the previous sheet 6*a* is performed to some extent. From the time point t2, the successive sheet 6*b* starts moving in a manner to be dragged by the previous sheet 6*a* due to some reason.

At the time point t3, the leading end of the successive sheet 6*b* reaches the nip position P1*a*. From the time point t3, multi-feed of the previous sheet 6*a* and the successive sheet 6*b* starts. The movement of the successive sheet 6*b* is slightly later than that of the previous sheet 6*a* denoted by a dot-dash line in the drawing.

At the time point t4, the successive sheet 6*b* reaches the position of the movement amount sensors 55 and 56. The multi-feed is detected based on the results of detection by the movement amount sensors 55 and 56, and the projection amount L1(*t*) is calculated. During a period between the time point t4 and the time point t5, the projection amount L1(*t*) is updated at intervals as discussed above.

At the time point t5, the previous sheet 6*a* reaches the position of the conveyance sensor 51. Since driving the advancing rollers (advancing operation) is finished, the successive sheet 6*b* stops with a part thereof extending from the nip position P1*a*. Further, updating the projection amount L1(*t*) is finished, so that the value of the projection amount L1(*t*) is fixed.

The next advancement command is given during a period between the time point t5 and the time point t6. A case is assumed herein in which, at the time point t2, the successive sheet 6*b* does not start moving and only the previous sheet 6*a* is normally advanced. In such an assumed case, when receiving the next advancement command, the conveyance control portion 130 starts advancing the next sheet 6 at the time point t6. Prior to the time point t6, the pickup roller 35 is driven to send the sheet 6 to be advanced to the nip position P1*a*.

In the assumed case, the time point t6 is a time at which advancing the next sheet 6 is to be started with a predetermined interval d between the next sheet 6 and the previous sheet 6*a* currently conveyed. The interval d is a minimum interval or an interval larger than the same for smooth image formation.

In the illustrated example of FIG. 17, however, multi-feed occurs contrary to the assumed case and the successive sheet 6*b* extends from the nip position P1*a*. Therefore, in advancing the successive sheet 6*b* as the next sheet 6 at the time point t6, an interval from the previous sheet 6*a* is unfortunately shorter than the predetermined interval d when the advancing is started at the time point t6.

In view of this, the conveyance control portion 130 drives the advancing rollers 36 to start supplying the successive sheet 6*b* at a time point t7 later than the time point t6. Stated differently, the advancement time of the successive sheet 6*b* is delayed to provide the predetermined interval d between the previous sheet 6*a* and the successive sheet 6*b*. The processing in Step #24 of FIG. 16 is to determine a delay time of the advancement time (a time between the time point t6 and the time point t7). A longer delay time is necessary for a larger projection amount L1(*t*).

In the case where the successive sheet 6*b* is advanced once again in the foregoing manner, it is not necessary to cancel the advancing operation even if multi-feed is detected. Since the advancing operation is not cancelled, it is not necessary to suspend the print job. This prevents the multi-feed from lowering productivity of printing by the image forming apparatus 1. In addition, it is unnecessary to work to remove the successive sheet 6*b* from the paper path 5 unlike the case of cancelling the advancing operation. In short, a burden to be put on the user is alleviated.

In the foregoing description, the example is provided in which the movement amount sensors 55 and 56 are disposed in the vicinity of the advancing mechanism 32 on the paper path 5. The movement amount sensors 55 and 56 may be disposed in another position.

Figure 18:
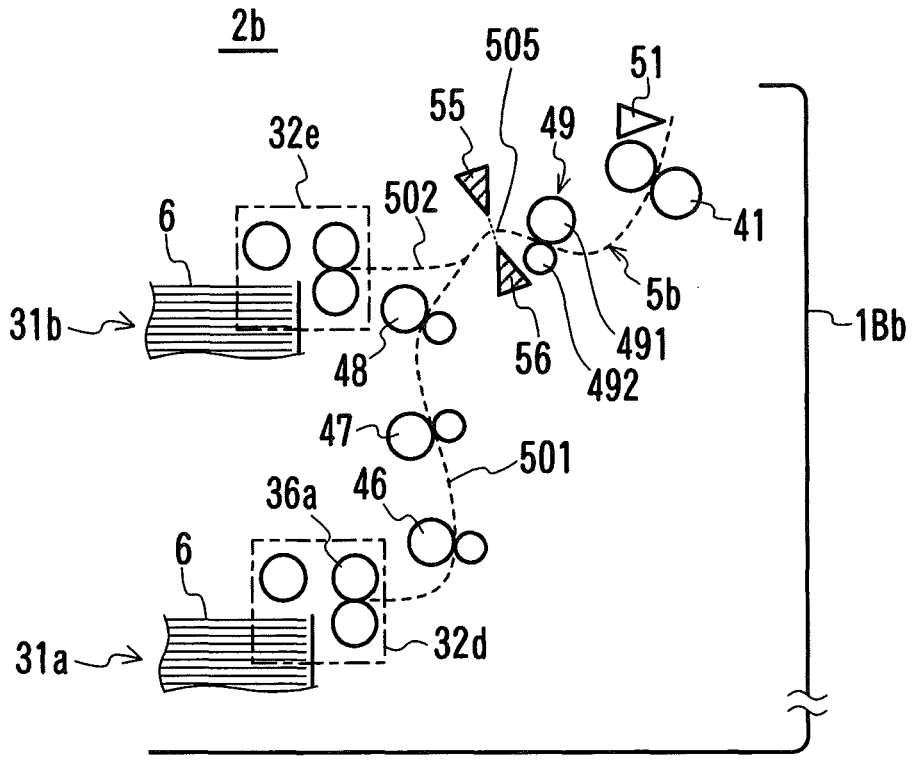
FIG. 18 is a diagram showing another layout example of movement amount sensors.

FIG. 18 shows another layout example of the movement amount sensors 55 and 56. In FIG. 18, elements having the similar functions to those of FIG. 1 are provided with the same symbols.

The sheet conveyance apparatus 2*b* of FIG. 18 basically has the same configuration as that of the sheet conveyance apparatus 2 of FIG. 2 except that the layout of the movement amount sensors 55 and 56 is different and that a paper path 5*b* is slightly complex as compared to the case of FIG. 2.

With the sheet conveyance apparatus 2*b*, the movement amount sensors 55 and 56 are provided in the paper path 5*b* within a two-stage sheet container unit 1Bb.

The sheet container unit 1Bb is provided with two sheet containing portions 31*a* and 31*b*, two advancing mechanisms 32*d* and 32*e*, the paper path 5*b*, the conveyance rollers 41, 46, 47, 48, and 49, the conveyance sensor 51, the first movement amount sensor 55, the second movement amount sensor 56, and so on. Instead of the sheet container unit 1B of FIG. 1, the sheet container unit 1Bb is configured to combine with the main unit 1A.

Each of the sheet containing portions 31*a* and 31*b* is configured to hold a plurality of sheets 6. The advancing mechanism 32*d* supplies the sheets 6 held in the lower sheet containing portion 31*a* to the paper path 5*b*. The advancing mechanism 32*e* supplies the sheets 6 held in the upper sheet containing portion 31*b* to the paper path 5*b*. The advancing mechanisms 32*d* and 32*e* may be any one of the reverse separation type, the corner claws separation type, or, the air separation type. The advancing mechanisms 32*d* and 32*e* may be of another type.

The paper path 5*b* includes an advancement path 501 extending upward from the lower advancing mechanism 32*d*, and an advancement path 502 extending from the upper advancing mechanism 32*e*. The paper path 5*b* is so formed that the advancement paths 501 and 502 join together to extend in the downstream. The paper path 5*b* has a curved part 505 in the vicinity of the downstream of the joining part of the advancement paths 501 and 502.

The first movement amount sensor 55 and the second movement amount sensor 56 are disposed at the curved part 505 of the paper path 5*b* to face each other with the paper path 5*b* interposed therebetween. The first movement amount sensor 55, which is disposed on the convex side of the curve, detects a movement amount of the sheet 6. The second movement amount sensor 56, which is disposed on the concave side of the curve, detects a movement amount of the sheet 6.

The conveyance rollers 46, 47, and 48 are disposed in the advancement path 501 on the low side of the paper path 5*b*. The conveyance rollers 49 are disposed in the vicinity of the downstream of the curved part 505 on the paper path 5*b*. The conveyance rollers 41 are disposed in the downstream as compared to the conveyance rollers 49. The conveyance rollers 46, 47, 48, and 49, and the conveyance rollers 41 serve to convey the sheet 6 supplied by the advancing mechanism 32*d* or the advancing mechanism 32*e* to the timing rollers 42 (see FIG. 1). As with the example of FIG. 1, the conveyance sensor 51 is disposed in the vicinity of the downstream of the conveyance rollers 41.

The conveyance rollers 41 are both driving rollers as described above. The conveyance rollers 46 are a pair of the driving roller and the driven roller. The same applies to the conveyance rollers 47, 48, and 49. In the illustrated example of FIG. 18, a circle representing a driven roller is smaller than a circle representing a driving roller. However, diameters of the actual rollers are not limited to the example in which the driving roller and the driven roller have different diameters.

With the foregoing structure, when the sheet 6 conveyed by the conveyance rollers 49 passes through the curved part 505, a difference in load resistance is made between one and the other of the conveyance rollers 49. To be specific, in the example of FIG. 18, a load resistance of a driven roller 492 corresponding to the concave side of the curve is larger than a load resistance of a driving roller 491 corresponding to the convex side thereof.

For this reason, when two sheets 6 overlapping each other pass through the curved part 505, a movement amount of the sheet 6 having a larger load resistance is smaller than a movement amount of the sheet 6 having a smaller load resistance.

Thus, it is possible to detect multi-feed by comparing the result of detection by the movement amount sensor 55 and the result of detection by the movement amount sensor 56.

The movement amount sensors 55 and 56 are disposed in the downstream of the joining position on the paper path 5*b*. Thereby, a pair of the movement amount sensors 55 and 56 is capable of detecting multi-feed of the advanced sheets 6 independently of which of the sheet containing portions 31*a* and 32*a* is selected, by the user, as the supply source of the sheet 6. This configuration halves the number of movement amount sensors 55 and 56, and prevents increase in cost of the image forming apparatus 1 as compared to the case where a pair of movement amount sensors 55 and 56 is disposed in the vicinity of each of the advancing mechanisms 32*d* and 32*e*.

Figure 19:
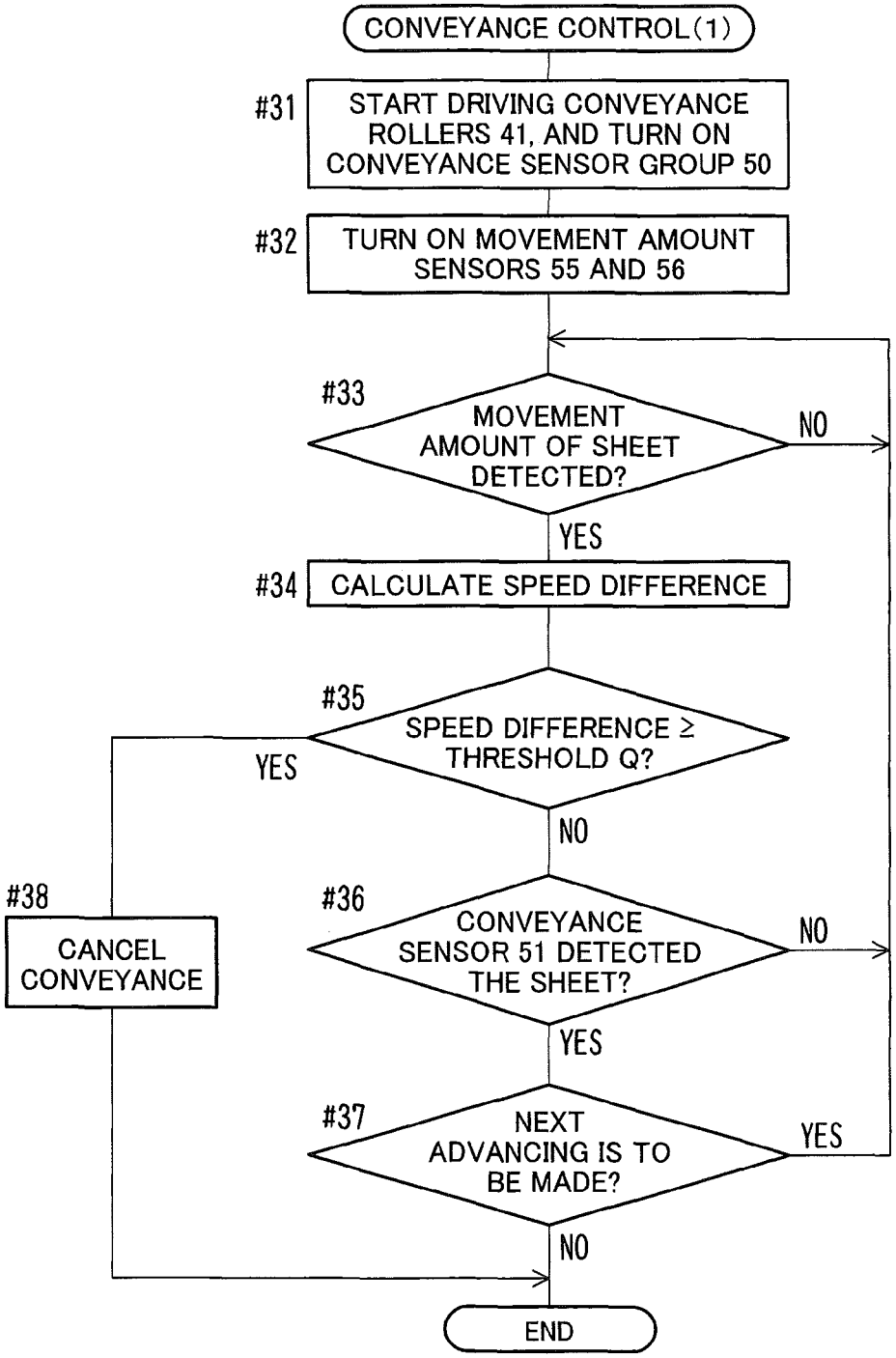
FIG. 19 is a flowchart for depicting a first example of conveyance control in a sheet conveyance apparatus.

FIG. 19 depicts a first example of conveyance control in the sheet conveyance apparatus 2*b*. The first example is an example in which the conveyance is cancelled immediately after multi-feed is detected.

Referring also to FIGS. 1-3, when the image forming apparatus 1 is given a print job, the conveyance control portion 130 of the CPU 101 starts driving the conveyance rollers 41, and also turns ON the conveyance sensor 51 (Step #31). After that, the conveyance control portion 130 turns ON the movement amount sensors 55 and 56 (Step #32).

The determination portion 151 waits for the movement amount sensors 55 and 56 to detect the movement amounts MV1 and MV2 of the sheet 6 (Step #33). When the movement amounts MV1 and MV2 are detected (YES in Step #33), the determination portion 151 calculates a speed difference which is the difference between the movement amounts MV1 and MV2 (Step #35).

The determination portion 151 then checks whether or not the speed difference calculated is equal to or greater than the threshold Q (Step #36).

If the speed difference is equal to or greater than the threshold Q (YES in Step #35), then the determination portion 151 determines that the conveyance state of the sheet 6 is multi-feed. The determination portion 151 then informs the conveyance control portion 130 that multi-feed is detected. In response to the information, the conveyance control portion 130 controls the conveyance drive system 30 to promptly cancel the conveyance (Step #38). If the advancing mechanism 32 performs the advancing operation at this time, the advancing operation is cancelled. Then, the processing for conveyance control is finished. The image forming apparatus 1 displays an error message to inform the user of a paper jam, and waits for the user to remove the sheet 6 remaining on the paper path 5*b*.

On the other hand, if the speed difference is smaller than the threshold Q (NO in Step #35), then the conveyance of the sheet 6 continues. In such a case, the conveyance control portion 130 checks whether or not the conveyance sensor 51 has detected the sheet 6 (Step #36).

If the conveyance sensor 51 has not detected the sheet 6 (NO in Step #36), then the processing goes back to Step #33. To be specific, the processing for detecting multi-feed (Step #33-Step #35) is repeatedly performed until the conveyance sensor 51 detects the sheet 6.

If the conveyance sensor 51 detects the sheet 6 (YES in Step #36), then the conveyance control portion 130 checks whether or not the next advancing is to be made (Step #37). If the next advancing is to be made (YES in Step #37), then the processing goes back to Step #33. If the next advancing is not to be made (NO in Step #37), then the processing is finished.

Figure 20:
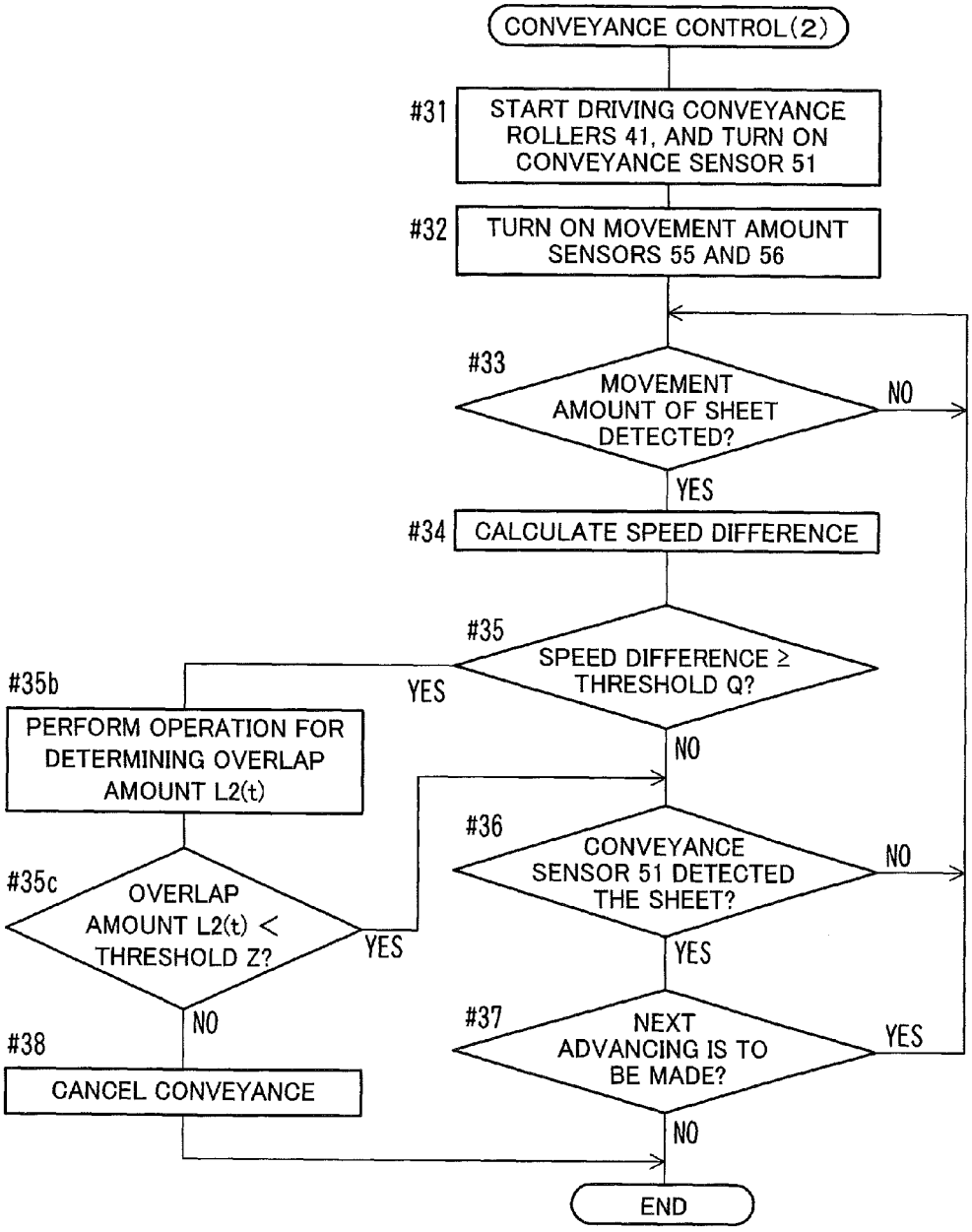
FIG. 20 is a flowchart for depicting a second example of conveyance control in a sheet conveyance apparatus.

FIG. 20 depicts a second example of conveyance control in the sheet conveyance apparatus 2*b*. In the second example, when multi-feed is detected, the conveyance is controlled in accordance with an overlap amount L2(*t*). The basic processing in the second example is, however, the same as that of the first example of FIG. 19. In FIG. 20, steps that are same as those in FIG. 19 are identified with the identical step numbers, and the description thereof will be omitted or will be simplified.

In the second example, if the speed difference is equal to or greater than the threshold Q in Step #35 and the determination portion 151 determines that the conveyance state is multi-feed, in short, if multi-feed is detected, then the overlap amount calculation portion 153 performs operation for determining a value of the overlap amount L2(*t*) at this time (Step #35*b*). The overlap amount L2(*t*) represents a length of an overlap part of sheets 6 as described above.

The conveyance control portion 130 checks whether or not the value of the overlap amount L2(*t*) obtained in Step #35*b* is smaller than a threshold Z (Step #35*c*). If the value of the overlap amount L2(*t*) is not smaller than the threshold Z (NO in Step #35*c*), then the conveyance control portion 130 cancels the conveyance (Step #38).

On the other hand, if the value of the overlap amount L2(*t*) is smaller than the threshold Z (YES in Step #35*c*), then the processing goes to Step #36. In such a case, the conveyance is not cancelled, and the sheets 6 keep moving in the multi-feed state. The presence/absence of multi-feed is determined at intervals (Step #33-Step #35) while the conveyance is continued. The operation of Step #35*b* is performed to update the overlap amount L2(*t*) every time multi-feed is detected.

The post-update overlap amount L2(*t*) is expressed by the following equation.

$$\text{Overlap amount } L2(t) = \text{overlap amount } L2(t-1) + \text{movement amount} \times \text{elapsed time } t$$

wherein the overlap amount L2(*t*−1) represents a value of the overlap amount L2(*t*) before the update, and the initial value is 0 (zero). The movement amount may be the movement amount MV1 detected by the first movement amount sensor 55, or may be the movement amount MV2 detected by the second movement amount sensor 56. The elapsed time t represents a time between the previous operation and the current operation.

The threshold Z used for the check in Step #35*c* is a value based on which the multi-feed corresponds to a critical trouble for which the conveyance is to be stopped, or to a minor trouble which does not affect the conveyance even if the conveyance is continued. The threshold Z is set to be a value falling within a range which is smaller than a length of the trailing end of a margin which is provided, for image formation, along the rim of the sheet 6. This is based on the consideration that, when the successive sheet 6*b* overlaps an image formation region other than the margin of the previous sheet 6*a*, non-uniform temperature occurs, for fixing, in the previous sheet 6*a* and the image quality is probably lowered.

In the second example of conveyance control shown in FIG. 20, even when multi-feed occurs, the conveyance is not cancelled for the case where the overlap amount L2(*t*) is smaller than the threshold Z. This minimizes interruption of print job, which prevents the productivity of printing from lowering.

The description now goes on to processing for enhancing reliability of multi-feed detection.

Figure 21:
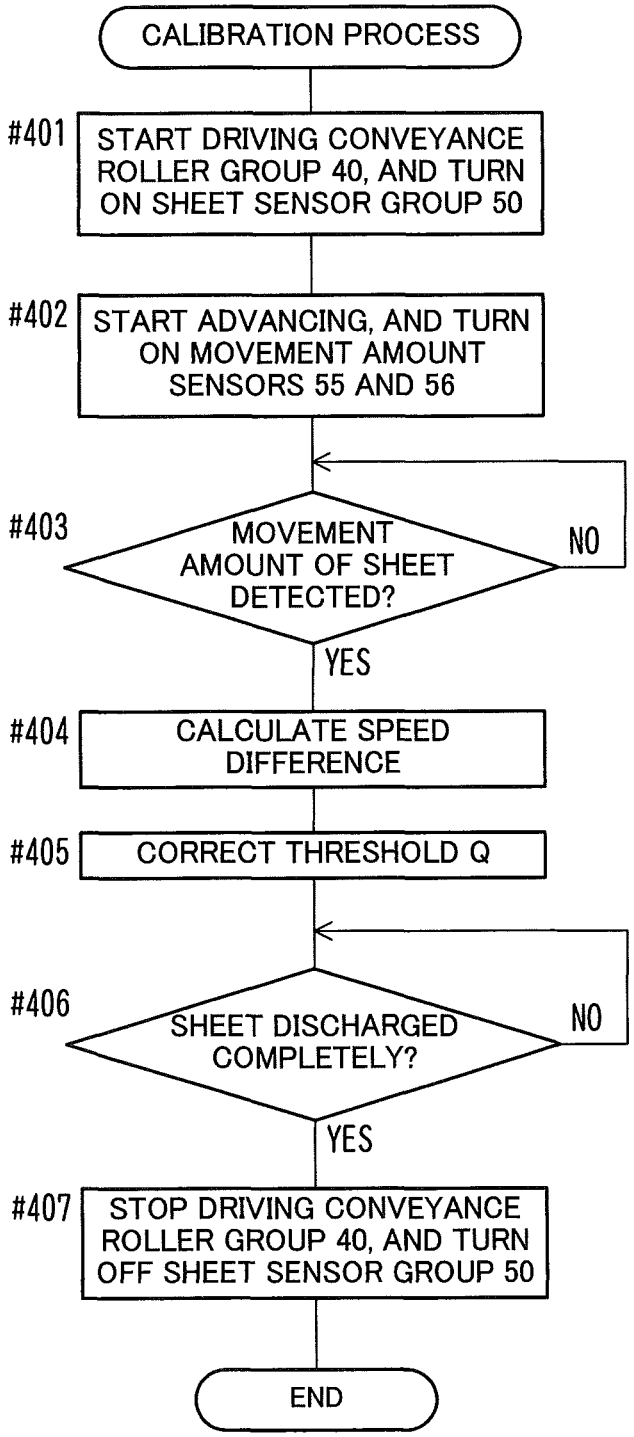
FIG. 21 is a flowchart for depicting a calibration process related to operating characteristics of movement amount sensors.

FIG. 21 depicts a calibration process related to operating characteristics of the movement amount sensors 55 and 56.

In the foregoing first test mode, the conveyance control portion 130 starts driving the conveyance roller group 40, and turns ON the sheet sensor group 50 (Step #401). The conveyance control portion 130 then controls the advancing mechanism 32 to start advancing the sheet 6, and turns ON the movement amount sensors 55 and 56 (Step #402). The test conveyance starts by starting advancing the sheet 6.

The calibration processing portion 154 waits for the movement amount sensors 55 and 56 to detect the movement amounts MV1 and MV2 of the sheet 6 (Step #403). If the movement amounts MV1 and MV2 are detected (YES in Step #403), then the calibration processing portion 154 calculates the speed difference which is the difference between the movement amounts MV1 and MV2 (Step #404).

The calibration processing portion 154 then corrects the threshold Q in accordance with the speed difference calculated. To be specific, the speed difference calculated as described above is added to the basic value Qi of the threshold Q (Step #405). For example, in the case where the speed obtained by converting the movement amount MV1 into an amount per second is 150.0 mm/s, and where the speed obtained by converting the movement amount MV1 is 149.5 mm/s, the speed difference is 0.5 mm/s. Where the basic value Qi before the correction is 10 mm/s, the post-correction basic value Qi is 10.5 mm/s.

The speed difference obtained in the first test mode may not be added, as-is, to the basic value Qi in order to reflect the speed difference in the threshold Q. For example, depending on the speed difference determined in the first test mode, a contribution rate for the basic value Qi may be set. Then, the basic value Qi is multiplied by the contribution rate, so that the threshold Q is corrected.

When the calibration processing portion 154 stores the post-correction basic value Qi into the non-volatile memory 104, the conveyance control portion 130 waits for the sheet 6 to pass through the discharge sensor 53 and to be discharged completely (Step #406). When the sheet 6 is completely discharged (YES in Step #406), driving the conveyance roller group 40 is stopped and the sheet sensor group 50 is turned OFF (Step #407).

The advancing mechanism 32 may be stopped in Step #407, or may be stopped before Step #407, i.e., at a time at which the conveyance sensor 51 detects the sheet 6. The movement amount sensors 55 and 56 may be turned OFF appropriately after the detection of the movement amounts MV1 and MV2.

Figure 22:
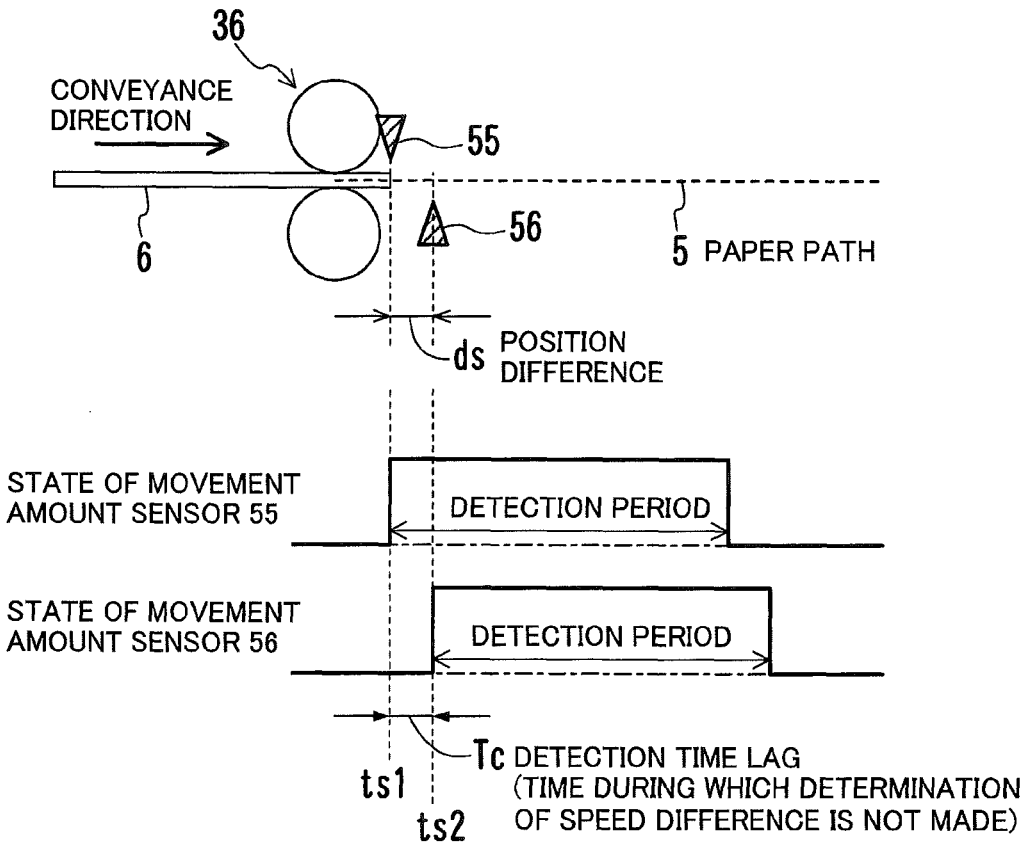
FIG. 22 is a diagram showing an example of the relationship between a position difference and a detection time lag between movement amount sensors.
Figure 23:
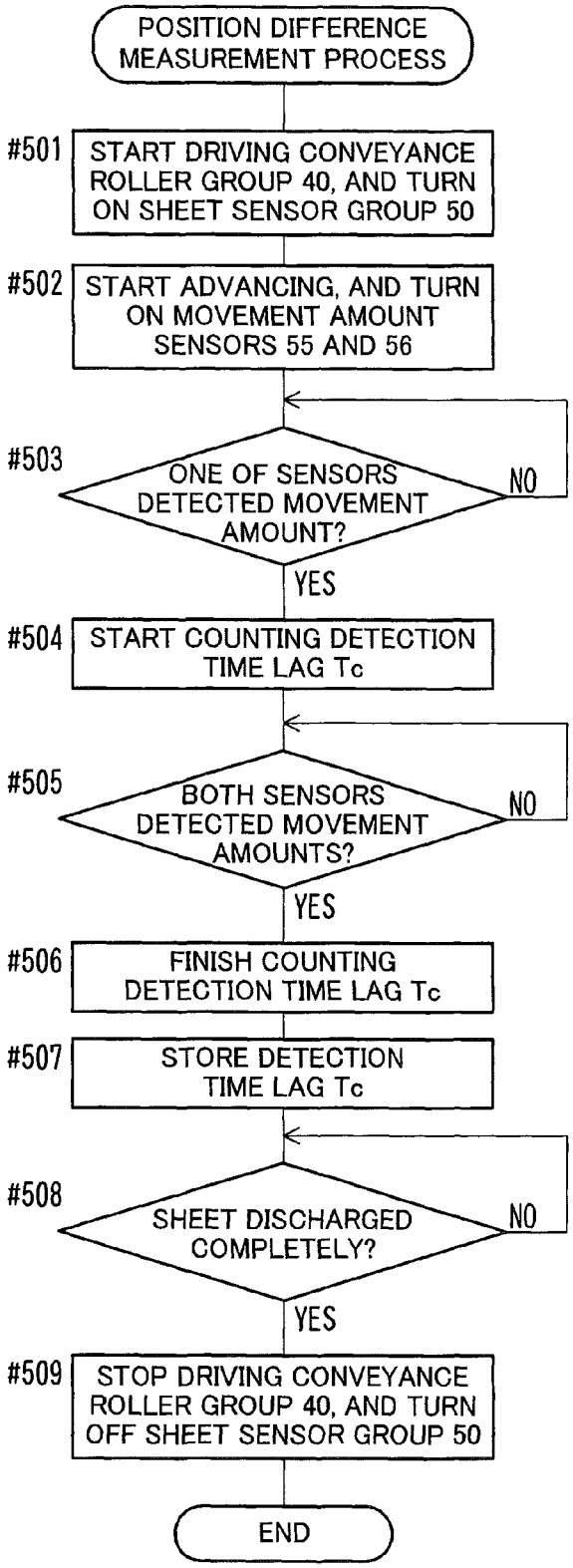
FIG. 23 is a flowchart for depicting a measurement process related to a position difference between movement amount sensors.

FIG. 22 shows an example of the relationship between a position difference ds and a detection time lag To between the movement amount sensors 55 and 56. FIG. 23 depicts the flow of a measurement process related to the position difference ds between the movement amount sensors 55 and 56.

In manufacturing the image forming apparatus 1, the position difference ds may occur between the movement amount sensor 55 and the movement amount sensor 56 as shown in FIG. 22. In the illustrated example, the movement amount sensor 55 is disposed in the upstream as compared to the movement amount sensor 56. Another case is possible in which the movement amount sensor 56 is disposed in the upstream as compared to the movement amount sensor 55.

In either case, it is supposed that, when the position difference ds occurs, the determination portion 151 uses the movement amount sensor 55 (or 56) disposed in the upstream to determine the speed difference at a time ts1 at which the movement amount MV1 (or MV2) is detected, and determines whether or not multi-feed occurs. In such a case, even when no multi-feed occurs, the determination portion 151 makes an erroneous determination that multi-feed occurs. This is because the movement amount MV2 (or MV1) detected by the movement amount sensor 56 (or 55) disposed in the downstream is 0 (zero), and the speed difference determined is larger than the threshold Q.

To address this, even when one movement amount sensor 55 (or 56) detects the movement amount MV1 (MV2) of the sheet 6 at the time ts1, the determination portion 151 does not make a determination on multi-feed. Instead of this, the determination portion 151 makes a determination on multi-feed at a time ts2 at which both the movement amount sensors 55 and 56 detect the movement amounts MV1 and MV2 of the sheet 6, or after the time ts2. In short, it is necessary to make a determination on multi-feed after the time ts2, taking into consideration the possibility of position difference ds.

For example, when the position difference ds is 2 mm, and the conveyance speed of the sheet 6 is 200 mm/s, the determination portion 151 waits for 10 ms without making a determination. Stated differently, when a cycle in which the determination portion 151 obtains the results of detection from the movement amount sensors 55 and 56 is 1 ms, the determination portion 151 waits, during a period corresponding to 10 cycles, without making a determination.

In this way, in the second test mode, a detection time lag Tc is measured during which the determination portion 151 has to wait without making a determination. The second test mode is designated, for example, at the time of the shipment of the image forming apparatus 1 from a factory. In the second test mode, test conveyance for conveying one sheet 6 is performed as with the first test mode.

Referring to FIG. 23, in the second test mode, the conveyance control portion 130 starts driving the conveyance roller group 40, and turns ON the sheet sensor group 50 (Step #501). The conveyance control portion 130 then controls the advancing mechanism 32 to start advancing the sheet 6, and turns ON the movement amount sensors 55 and 56 (Step #502). The test conveyance starts by starting advancing the sheet 6.

The measurement portion 155 waits for at least one of the movement amount sensors 55 and 56 to detect the movement amount MV1 (or MV2) (Step #503). If the movement amount MV1 (or MV2) is detected (YES in Step #503), then the measurement portion 155 starts counting the detection time lag Tc (Step #504).

The measurement portion 155 then waits for the movement amount sensor 55 to detect the movement amount MV1, and also waits for the movement amount sensor 56 to detect the movement amount MV2 (Step #505). If both the movement amount sensors 55 and 56 detect the movement amounts MV1 and MV2 (YES in Step #505), then the measurement portion 155 finishes counting the detection time lag Tc (Step #506), and stores the counted detection time lag Tc into the non-volatile RAM 104 (Step #507).

After that, the conveyance control portion 130 stops driving the conveyance roller group 40 to turn OFF the sheet sensor group 50 (Step #508 and Step #509) as with the first test mode. Stopping the advancing mechanism 32*a* and turning OFF the movement amount sensors 55 and 56 in the second test mode are also similar to those of the first test mode.

An operator who conducts the second test mode is allowed to modify the attachment position of the movement amount sensors 55 and 56 depending on the measurement result of the detection time lag Tc so as to reduce the position difference ds, to conduct the second test mode again after the modification, and to store the detection time lag Tc.

According to this embodiment, it is possible to detect multi-feed in a non-contact manner without deteriorating the sheet independently of what type of sheet is used.

In the foregoing embodiments, the type of sheet 6 is not limited to plain paper and thick paper. Classification into two types or more is possible based on properties of sheets which tend to cause multi-feed, e.g., surface smoothness and electrically charge characteristics.

In the first test mode and the second test mode, the case is described in which only one sheet 6 is placed in the sheet containing portion 31. The embodiment is not limited thereto. When the advancing mechanism 32*a* of a reverse separation type is used as the advancing mechanism 32, a plurality of sheets 6 may be placed in the sheet containing portion 31 provided that the thickness of the sheet 6 is enough for the separator roller 362 to separate sheets from one another securely.

It is to be understood that the configurations of the multi-feed detection apparatus 3, the sheet conveyance apparatuses 2 and 2*b*, and the image forming apparatus 1, the constituent elements thereof, the detection method by the movement amount sensors 55 and 56 and the layout thereof, the flow of control, and the like can be appropriately modified without departing from the spirit of the present invention.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A sheet conveyance apparatus for use by a user, the sheet conveyance apparatus comprising:

a sheet containing portion configured to hold a plurality of sheets therein;

an advancing mechanism configured to advance, to a paper path, the sheet held in the sheet containing portion;

a first movement amount sensor disposed on the paper path to face a first surface of the sheet to detect a movement amount of the sheet;

a second movement amount sensor disposed, on the paper path, in a position at which the first movement amount sensor is disposed to face a second surface of the sheet to detect a movement amount of the sheet;

a memory configured to store a cumulative usage of the sheet conveyance apparatus;

a humidity sensor structured to detect humidity of an installation site of the sheet conveyance apparatus;

a determination portion configured to determine that a conveyance state of the sheet is multi-feed when a difference between the movement amount of the sheet detected by the first movement amount sensor and the movement amount of the sheet detected by the second movement amount sensor is equal to or greater than a threshold;

wherein the threshold is set in accordance with a type of the sheet, the cumulative usage of the sheet conveyance apparatus, and the humidity of the installation site of the sheet conveyance apparatus; and wherein the type of the sheet is input by the user.

2. The sheet conveyance apparatus according to claim 1, wherein the first movement amount sensor and the second movement amount sensor are disposed, on the paper path, in a vicinity of the advancing mechanism.

3. The sheet conveyance apparatus according to claim 1, wherein the paper path has a curved part, and the first movement amount sensor and the second movement amount sensor are disposed in the curved part of the paper path.

4. The sheet conveyance apparatus according to claim 2, wherein the advancing mechanism includes a pickup roller configured to take the sheet out of the sheet containing portion, and advancing rollers having a feed roller configured to send the sheet taken by the pickup roller to the paper path, and a separator roller rotatable in a direction opposite to a conveyance direction of the feed roller, and the first movement amount sensor and the second movement amount sensor are disposed in a vicinity of a downstream on the paper path with respect to a nip position of the advancing rollers.

5. The sheet conveyance apparatus according to claim 2, wherein the advancing mechanism includes a pickup roller configured to take the sheet out of the sheet containing portion, the sheet containing portion includes corner claws for catching corner parts of an advancing end of the sheet supplied by the pickup roller to warp the sheet, and the first movement amount sensor and the second movement amount sensor are disposed in a vicinity of a downstream on the paper path with respect to a position at which the corner claws are provided.

6. The sheet conveyance apparatus according to claim 2, wherein the advancing mechanism includes an advancing belt which is disposed above the sheet containing portion to adsorb, by a negative pressure, the sheet held in the top of the sheet containing portion to send the sheet adsorbed to the paper path, and the first movement amount sensor and the second movement amount sensor are disposed in a vicinity of a downstream on the paper path with respect to a leading end position of the advancing belt.

7. The sheet conveyance apparatus according to claim 4, comprising a control unit configured to control conveyance of the sheet based on a result of determination by the determination portion, and a projection amount calculation portion configured to calculate, when the determination portion determines that a conveyance state of the sheet is multi-feed, and further, when a multi-fed successive sheet stops so as to project toward a downstream with respect to the advancing rollers, a projection amount of the successive sheet; wherein before starting advancing the successive sheet, the control unit delays a time at which the successive sheet is advanced by the advancing rollers depending on the projection amount.

8. A sheet conveyance apparatus comprising:

a sheet containing portion configured to hold a plurality of sheets therein;

an advancing mechanism configured to advance, to a paper path, the sheet held in the sheet containing portion;

a first movement amount sensor disposed on the paper path to face a first surface of the sheet to detect a movement amount of the sheet;

a second movement amount sensor disposed, on the paper path, in a position at which the first movement amount sensor is disposed to face a second surface of the sheet to detect a movement amount of the sheet;

a determination portion configured to determine that a conveyance state of the sheet is multi-feed when a difference between the movement amount of the sheet detected by the first movement amount sensor and the movement amount of the sheet detected by the second movement amount sensor is equal to or greater than a threshold; and a calibration processing portion configured to correct, in test conveyance of conveying one sheet, the threshold depending on the difference between the movement amount of the sheet detected by the first movement amount sensor and the movement amount of the sheet detected by the second movement amount sensor.

9. A sheet conveyance apparatus comprising:

a sheet containing portion configured to hold a plurality of sheets therein;

an advancing mechanism configured to advance, to a paper path, the sheet held in the sheet containing portion;

a first movement amount sensor disposed on the paper path to face a first surface of the sheet to detect a movement amount of the sheet;

a second movement amount sensor disposed, on the paper path, in a position at which the first movement amount sensor is disposed to face a second surface of the sheet to detect a movement amount of the sheet;

a determination portion configured to determine that a conveyance state of the sheet is multi-feed when a difference between the movement amount of the sheet detected by the first movement amount sensor and the movement amount of the sheet detected by the second movement amount sensor is equal to or greater than a threshold; and a measurement portion configured to measure, in test conveyance of conveying one sheet, a detection time lag which is a difference between the first movement amount sensor and the second movement amount sensor in time at which detection of the movement amount of the sheet is started; wherein in conveying the sheet not for the test conveyance, the determination portion determines whether or not a conveyance state of the sheet is multi-feed after the detection time lag measured by the measurement portion has elapsed since any one of the first movement amount sensor and the second movement amount sensor started detecting the movement amount of the sheet.

10. The sheet conveyance apparatus according to claim 8, wherein the first movement amount sensor and the second movement amount sensor are disposed, on the paper path, in a vicinity of the advancing mechanism.

11. The sheet conveyance apparatus according to claim 8, wherein the paper path has a curved part, and the first movement amount sensor and the second movement amount sensor are disposed in the curved part of the paper path.

12. The sheet conveyance apparatus according to claim 8, wherein the advancing mechanism includes a pickup roller configured to take the sheet out of the sheet containing portion, and advancing rollers having a feed roller configured to send the sheet taken by the pickup roller to the paper path, and a separator roller rotatable in a direction opposite to a conveyance direction of the feed roller, and the first movement amount sensor and the second movement amount sensor are disposed in a vicinity of a downstream on the paper path with respect to a nip position of the advancing rollers.

13. The sheet conveyance apparatus according to claim 8, wherein the advancing mechanism includes a pickup roller configured to take the sheet out of the sheet containing portion, the sheet containing portion includes corner claws for catching corner parts of an advancing end of the sheet supplied by the pickup roller to warp the sheet, and the first movement amount sensor and the second movement amount sensor are disposed in a vicinity of a downstream on the paper path with respect to a position at which the corner claws are provided.

14. The sheet conveyance apparatus according to claim 8, wherein the advancing mechanism includes an advancing belt which is disposed above the sheet containing portion to adsorb, by a negative pressure, the sheet held in the top of the sheet containing portion to send the sheet adsorbed to the paper path, and the first movement amount sensor and the second movement amount sensor are disposed in a vicinity of a downstream on the paper path with respect to a leading end position of the advancing belt.

15. The sheet conveyance apparatus according to claim 8, comprising a control unit configured to control conveyance of the sheet based on a result of determination by the determination portion, and a projection amount calculation portion configured to calculate, when the determination portion determines that a conveyance state of the sheet is multi-feed, and further, when a multi-fed successive sheet stops so as to project toward a downstream with respect to the advancing rollers, a projection amount of the successive sheet; wherein before starting advancing the successive sheet, the control unit delays a time at which the successive sheet is advanced by the advancing rollers depending on the projection amount.

16. The sheet conveyance apparatus according to claim 9, wherein the first movement amount sensor and the second movement amount sensor are disposed, on the paper path, in a vicinity of the advancing mechanism.

17. The sheet conveyance apparatus according to claim 9, wherein the paper path has a curved part, and the first movement amount sensor and the second movement amount sensor are disposed in the curved part of the paper path.

18. The sheet conveyance apparatus according to claim 9, wherein the advancing mechanism includes a pickup roller configured to take the sheet out of the sheet containing portion, and advancing rollers having a feed roller configured to send the sheet taken by the pickup roller to the paper path, and a separator roller rotatable in a direction opposite to a conveyance direction of the feed roller, and the first movement amount sensor and the second movement amount sensor are disposed in a vicinity of a downstream on the paper path with respect to a nip position of the advancing rollers.

19. The sheet conveyance apparatus according to claim 9, wherein the advancing mechanism includes a pickup roller configured to take the sheet out of the sheet containing portion, the sheet containing portion includes corner claws for catching corner parts of an advancing end of the sheet supplied by the pickup roller to warp the sheet, and the first movement amount sensor and the second movement amount sensor are disposed in a vicinity of a downstream on the paper path with respect to a position at which the corner claws are provided.

20. The sheet conveyance apparatus according to claim 9, wherein the advancing mechanism includes an advancing belt which is disposed above the sheet containing portion to adsorb, by a negative pressure, the sheet held in the top of the sheet containing portion to send the sheet adsorbed to the paper path, and the first movement amount sensor and the second movement amount sensor are disposed in a vicinity of a downstream on the paper path with respect to a leading end position of the advancing belt.

21. The sheet conveyance apparatus according to claim 9, comprising a control unit configured to control conveyance of the sheet based on a result of determination by the determination portion, and a projection amount calculation portion configured to calculate, when the determination portion determines that a conveyance state of the sheet is multi-feed, and further, when a multi-fed successive sheet stops so as to project toward a downstream with respect to the advancing rollers, a projection amount of the successive sheet; wherein before starting advancing the successive sheet, the control unit delays a time at which the successive sheet is advanced by the advancing rollers depending on the projection amount.

* * * * *